US006821065B2

(12) United States Patent
Forbes

(10) Patent No.: US 6,821,065 B2
(45) Date of Patent: Nov. 23, 2004

(54) AUTORACK RAIL ROAD CAR WITH REDUCED SLACK

(75) Inventor: James W. Forbes, Campbellville (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 10/366,094

(22) Filed: Feb. 12, 2003

(65) Prior Publication Data

US 2003/0129037 A1 Jul. 10, 2003

Related U.S. Application Data

(63) Continuation of application No. 09/658,856, filed on Sep. 11, 2000, now Pat. No. 6,551,039.

(51) Int. Cl.[7] ..... B60P 7/08

(52) U.S. Cl. ..... 410/26; 410/4; 410/24; 105/355; 105/378; 105/458

(58) Field of Search ..... 410/4, 24, 26, 410/29.1; 105/4.1, 4.3, 15, 18, 355, 375, 378, 458, 461

(56) References Cited

U.S. PATENT DOCUMENTS

| | | | |
|---|---|---|---|
| 401,529 | A | 4/1889 | Zurcher |
| 459,896 | A | 9/1891 | MacMillan |
| 774,205 | A | 11/1904 | Scott |
| 1,083,831 | A | 1/1914 | Holdaway et al. |
| 1,229,374 | A | 6/1917 | Youngblood |
| 1,514,211 | A | 11/1924 | Hester |
| 1,535,799 | A | 4/1925 | Adams |
| 1,608,665 | A | 11/1926 | Pehrson |
| 1,713,898 | A | 5/1929 | Gilpin |
| 1,735,617 | A | 11/1929 | Nystrom |
| 1,754,111 | A | 4/1930 | Latshaw |
| 1,841,066 | A | 1/1932 | Simning |
| 1,894,534 | A | 1/1933 | Dolan |
| 2,009,149 | A | 7/1935 | Pierce |
| 2,056,218 | A | 10/1936 | Stout |

(List continued on next page.)

FOREIGN PATENT DOCUMENTS

| | | |
|---|---|---|
| AT | 245610 | 3/1966 |
| CA | 2191673 | 5/1997 |
| CH | 329987 | 5/1958 |
| CH | 371475 | 10/1963 |
| DE | 473036 | 2/1929 |
| DE | 664933 | 8/1938 |
| DE | 688777 | 2/1940 |
| DE | 1 180 392 | 10/1964 |
| DE | 2318369 | 10/1974 |
| EP | 0 264 731 | 4/1988 |
| EP | 347334 | 12/1989 |
| EP | 494323 A | 7/1992 |
| FR | 1095600 | 6/1955 |
| IT | 324559 | 2/1935 |
| JP | 58-39558 | 3/1983 |
| JP | 63-279966 | 11/1988 |
| JP | 4-143161 | 5/1992 |

OTHER PUBLICATIONS

Road & Road—Wabash National Corporation Newsletter Issue 7, Summer 1996.

(List continued on next page.)

*Primary Examiner*—Stephen Gordon
(74) *Attorney, Agent, or Firm*—Hahn Loeser & Parks LLP; Michael H. Minns

(57) ABSTRACT

A rail road car has a rail car body which includes a housing structure. The housing structure has a pair of sidewalls, a roof and at least one deck mounted to the sidewalls. An enclosed lading space is defined by the housing structure and there is at least one door for controlling access to the enclosed space. The rail road car is provided with short travel buff gear and a reduced slack, or slackless, coupler.

19 Claims, 12 Drawing Sheets

U.S. PATENT DOCUMENTS

| | | | |
|---|---|---|---|
| 2,132,001 | A | 10/1938 | Dean |
| 2,147,014 | A | 2/1939 | Demarest |
| 2,155,615 | A | 4/1939 | Rice |
| 2,223,746 | A | 12/1940 | Stoner |
| 2,432,228 | A | 12/1947 | De Lano |
| 2,517,811 | A | 8/1950 | Torburn |
| 2,565,709 | A | 8/1951 | Watter |
| 2,580,326 | A | 12/1951 | Stevens |
| 2,659,318 | A | 11/1953 | Steins et al. |
| 2,801,597 | A | 8/1957 | Ecoff |
| 2,865,306 | A | 12/1958 | Bock et al. |
| 2,929,339 | A | 3/1960 | Schueder et al. |
| 2,959,262 | A | 11/1960 | Parker et al. |
| 3,017,840 | A | 1/1962 | Fairweather |
| 3,099,230 | A | 7/1963 | De Podesta |
| 3,102,497 | A | 9/1963 | Candlin et al. |
| 3,119,350 | A | 1/1964 | Bellingher |
| 3,173,382 | A | 3/1965 | Ryan |
| 3,179,067 | A | 4/1965 | Beck et al. |
| 3,205,836 | A | 9/1965 | Wojcikowski |
| 3,221,669 | A | 12/1965 | Baker et al. |
| 3,230,900 | A | 1/1966 | Ruprecht et al. |
| 3,240,167 | A | 3/1966 | Podesta et al. |
| 3,290,058 | A | 12/1966 | Ellerd |
| 3,323,472 | A | 6/1967 | Boone et al. |
| 3,370,552 | A | 2/1968 | Podesta et al. |
| 3,405,661 | A | 10/1968 | Erickson et al. |
| 3,426,704 | A | 2/1969 | Blunden |
| 3,503,340 | A | 3/1970 | Warren |
| 3,516,706 | A | 6/1970 | Bruce |
| 3,547,049 | A | 12/1970 | Sanders |
| 3,678,863 | A | 7/1972 | Pringle |
| 3,709,154 | A | 1/1973 | Peisner et al. |
| 3,815,517 | A | 6/1974 | Przyblinski |
| 3,854,425 | A | 12/1974 | Allen |
| 3,857,414 | A | 12/1974 | Thoman et al. |
| 3,871,276 | A | 3/1975 | Allen |
| 3,895,587 | A | 7/1975 | Bell |
| 3,927,621 | A | 12/1975 | Skeltis et al. |
| 3,995,563 | A | 12/1976 | Blunden |
| 4,084,516 | A | 4/1978 | Ravani et al. |
| 4,089,538 | A | 5/1978 | Eastridge |
| 4,116,135 | A | 9/1978 | Jaekle et al. |
| 4,119,042 | A | 10/1978 | Naves et al. |
| 4,119,043 | A | 10/1978 | Naves et al. |
| 4,128,062 | A | 12/1978 | Roberts |
| 4,149,472 | A | 4/1979 | Naves et al. |
| 4,191,107 | A | 3/1980 | Ferris et al. |
| 4,233,909 | A | 11/1980 | Adams et al. |
| 4,336,758 | A | 6/1982 | Radwill |
| 4,421,339 | A | 12/1983 | Hagin |
| 4,437,410 | A | 3/1984 | Stoller, Sr. et al. |
| 4,503,779 | A | 3/1985 | Chadwick |
| 4,615,275 | A | 10/1986 | Ishizuka |
| 4,667,604 | A | 5/1987 | Baker |
| 4,671,714 | A | 6/1987 | Bennett |
| 4,677,918 | A | 7/1987 | Baker et al. |
| 4,701,086 | A | 10/1987 | Thorndyke |
| 4,721,426 | A | 1/1988 | Bell et al. |
| 4,751,882 | A | 6/1988 | Wheatley et al. |
| 4,759,669 | A | 7/1988 | Robertson et al. |
| 4,786,222 | A | 11/1988 | Blodgett |
| 4,881,859 | A | 11/1989 | Ehrlich |
| 4,924,780 | A | 5/1990 | Hart |
| 4,929,132 | A | 5/1990 | Yeates et al. |
| 4,936,227 | A | 6/1990 | Baker et al. |
| 4,942,824 | A | 7/1990 | Cros |
| 4,947,760 | A | 8/1990 | Dawson et al. |
| 4,966,081 | A | 10/1990 | Dominguez et al. |
| 4,992,013 | A | 2/1991 | Westerdale |
| 5,010,614 | A | 4/1991 | Braemert et al. |
| 5,042,395 | A | 8/1991 | Wackerle et al. |
| 5,046,582 | A | 9/1991 | Albrecht |
| 5,106,246 | A | 4/1992 | Chance |
| 5,140,912 | A | 8/1992 | Hesch |
| 5,152,228 | A | 10/1992 | Donkin |
| 5,174,211 | A | 12/1992 | Snead |
| 5,218,794 | A | 6/1993 | Ehrlich |
| 5,271,335 | A | 12/1993 | Bogenschutz |
| 5,271,511 | A | 12/1993 | Daugherty, Jr. et al. |
| 5,286,149 | A | 2/1994 | Seay et al. |
| 5,320,046 | A | 6/1994 | Hesch |
| 5,362,345 | A | 11/1994 | Stettler et al. |
| 5,383,406 | A | 1/1995 | Vanolo et al. |
| 5,392,717 | A | 2/1995 | Hesch et al. |
| 5,511,491 | A | 4/1996 | Hesch et al. |
| 5,515,792 | A | 5/1996 | Bullock et al. |
| 5,596,936 | A | 1/1997 | Bullock et al. |
| 5,601,033 | A | 2/1997 | Ehrlich et al. |
| 5,601,034 | A | 2/1997 | Tao et al. |
| 5,622,115 | A | 4/1997 | Ehrlich et al. |
| 5,657,698 | A | 8/1997 | Black, Jr. et al. |
| 5,685,228 | A | 11/1997 | Ehrlich et al. |
| 5,685,229 | A | 11/1997 | O'hara et al. |
| 5,690,033 | A | 11/1997 | Andre |
| 5,730,578 | A | 3/1998 | Smidler |
| 5,743,192 | A | 4/1998 | Saxton et al. |
| 5,762,798 | A | 6/1998 | Wenthold et al. |
| 5,765,486 | A | 6/1998 | Black, Jr. et al. |
| 5,782,187 | A | 7/1998 | Black, Jr. et al. |
| 5,794,537 | A | 8/1998 | Zaerr et al. |
| 5,832,836 | A | 11/1998 | Ehrlich et al. |
| 5,845,584 | A | 12/1998 | Bullock et al. |
| 5,857,414 | A | 1/1999 | Thoman et al. |
| 6,244,801 | B1 | 6/2001 | Klag et al. |
| 6,551,039 | B1 * | 4/2003 | Forbes ..... 410/26 |

OTHER PUBLICATIONS

1997 Car and Locomotive Cyclopedia (Simmons–Boardman Books, Inc., Omaha, 1997 ISBN 0–911382–20–8) at pp. 640–702.

Photographs of experimental multi–unit articulated railroad flat car with short travel draft gear and reduced slack couplers developed by Canadian Pacific Railways, date unknown.

* cited by examiner

SYMM. ABOUT ℄
400
402
404
405
406
408
410
412
414
416
418
430
432
448

AUTORACK RAIL ROAD CAR WITH REDUCED SLACK

RELATED APPLICATIONS

This is a continuation application of U.S. patent application Ser. No. 09/658,856, filed Sep. 11, 2000, now U.S. Pat. No. 6,551,039, issued Apr. 22, 2003, the specification of which is hereby incorporated by reference.

FIELD OF THE INVENTION

This invention relates to the field of auto rack rail road cars for carrying motor vehicles.

BACKGROUND OF THE INVENTION

Auto rack rail road cars are used to transport automobiles. Most often, although not always, they are used to transport finished automobiles from a factory to a distribution center. A long standing concern has been the frequency of damage claims arising from high accelerations imposed on the lading during train operation. Many of these damage claims are related to slack action in the train. In this context, slack action includes (a) the free slack in the couplers; and (b) the travel of the draft gear of successive rail road cars under the varying buff and draft loads. Slack run-out occurs, for example, as a train climbs a long upgrade, and all of the slack is taken out of the couplings as the train stretches. Once the train clears the crest, and begins a relatively steep descent, the rail road cars at the end of the train may tend to accelerate downhill into the cars in front, closing up the slack. This slack run-in and run-out can result in significant longitudinal accelerations. These accelerations are transmitted to the automobiles carried in the auto-rack cars.

Historically, the need for slack was related, at least in part, to the difficulty of using a steam locomotive to "lift" (that is, move from a standing start) a long string of cars with journal bearings, particularly in cold weather. Steam engines were reciprocating piston engines whose output torque at the drive wheels varied as a function of crank angle. By contrast, presently operating diesel-electric locomotives are capable of producing high tractive effort from a standing start, without concern about crank angle or wheel angle. For practical purposes, presently available diesel-electric locomotives are capable of lifting a unit train of one type of cars having little or no slack.

Switching is another process having a long history. Two common types of switching are "flat switching" and "humping". Humping involves running freight cars successively over a raised portion of track, and then allowing the car to run down-hill under gravity along various leads and sidings to couple with other cars as a train consist is assembled. For this type of operation the coupling speeds can be excessive, resulting in similarly excessive car body accelerations. For many types of rail road car, humping is now forbidden due to the probability of damaging the lading. An alternate form of switching is "flat switching" in which a locomotive is used to give a push to a rail road car, and then to send it rolling under its own inertia down a chosen siding to couple with another car. Particularly when done at night, the desirability of making sure that a good coupling is made tends to encourage rail yard personnel to make sure that the rail road cars are given an extra generous push. This often less than gentle habit tends to lead to rather high impact loads during coupling at impacts in the 5 m.p.h. (or higher) range. Forces can be particularly severe when there is an impact between a low density lading rail road car, such as an auto rack car, and a high density lading car (or string of cars) such as coal or grain cars.

Given this history, rail road car draft gear are designed to cope with slack run-out and slack run-in during train operation, and also to cope with the impact as cars are coupled together. Historically, common types of draft gear, such as that complying with, for example, AAR specification M-901-G, have been rated to withstand an impact at 5 m.p.h. (8 km/h) at a coupler force of 500,000 lbs. (roughly $2.2\times10^6$ N). Typically, these draft gear have a travel of 2¾ to 3¼ inches in buff before reaching the 500,000 lbs. load, and before "going solid". The term "going solid" refers to the point at which the draft gear exhibits a steep increase in resistance to further displacement. If the impact is large enough to make the draft gear "go solid" then the force transmitted, and the corresponding acceleration imposed on the lading, increases sharply. While this may be acceptable for coal or grain, it is undesirably severe for more sensitive lading, such as automobiles or auto parts, paper, and other consumer goods such as household appliances.

Consequently, from the relatively early days of the automobile industry, there has been a history of development of longer travel draft gear to provide lading protection for relatively high value, low density lading, in particular automobiles and auto parts, but also farm machinery, or tractors, or highway trailers. Draft gear development has tended to be directed toward providing longer travel on impact to reduce the peak acceleration. In the development of sliding sills, and latterly, hydraulic end of car cushioning (EOCC) units, the same impact is accommodated over 10, 15, or 18 inches of travel. As a result, for example, by the end of the 1960's nearly all auto rack cars, and other types of special freight cars had EOCC units. Further, of the approximately 45,000 auto-rack cars in service in 1997, virtually all were equipped with end of car cushioning units. A discussion of the developments of couplers, draft gear and EOCC equipment is given the 1997 Car and Locomotive Cyclopedia (Simmons-Boardman Books, Inc., Omaha, 1997 ISBN 0-911382-20-8) at pp. 640–702. In summary, there has been a long development of long travel draft gear equipment to protect relatively fragile lading from end impact loads.

In light of the foregoing, it is counter-intuitive to employ short-travel, or ultra short travel, draft gear for carrying wheeled vehicles. However, by eliminating, or reducing, the accumulation of slack, the use of short travel buff gear may tend to reduce the relative longitudinal motion between adjacent rail road cars, and may tend to reduce the associated velocity differentials and accelerations between cars. The use of short travel, or ultra-short travel, buff gear also has the advantage of eliminating the need for relatively expensive, and relatively complicated EOCC units, and the fittings required to accommodate them. This may tend to permit savings both at the time of manufacture, and savings in maintenance during service.

Further, as noted above, given the availability of locomotives that develop continuous high torque from a standing start, it is possible to re-examine the issue of slack action from basic principles. The use of vehicle carrying rail road cars in unit trains that will not be subject to operation with other types of freight cars, that will not be subject to flat switching, and that may not be subject to switching at all when loaded, provides an opportunity to adopt a short travel, reduced slack coupling system throughout the train. The conventional approach has been to adopt end of car equipment with sufficient travel to cope with existing slack accumulation between cars. In doing so, the long travel end of car equipment has tended to add to the range of slack action in the train that is to be accommodated by the draft gear along the train. The opposite approach, as adopted herein, is to avoid a large accumulation of slack in the first place. If a large amount of slack is not allowed to build up along the train, then the need for long-travel draft gear and other end of car equipment is also reduced, or, preferably, eliminated.

One way to reduce slack action is to use fewer couplings. To that end, since articulated connectors are slackless, use of articulated rail road cars significantly reduces the slack action in the train. Some releasable couplings are still necessary, to permit the composition of a train to change, if desired. Further, it is necessary to be able to change out a car for repair or maintenance when required.

To reduce overall slack, it would be advantageous to adopt a reduced slack, or slackless, coupler, (as compared to AAR Type E). Although reduced slack AAR Type F couplers have been known since the 1950's, and slackless "tightlock" AAR Type H couplers became an adopted standard type on passenger equipment in 1947, AAR Type E couplers are still predominant. AAR Type H couplers are expensive, and are used for passenger cars, as were the alternate standard Type CS controlled slack couplers. According to the 1997 Cyclopedia, supra, at p. 647 "Although it was anticipated at one time that the F type coupler might replace the E as the standard freight car coupler, the additional cost of the coupler and its components, and of the car structure required to accommodate it, have led to its being used primarily for special applications". One "special application" for F type couplers is in tank cars, another is in rotary dump coal cars.

The difference between the nominal ⅜" slack of a Type F coupler and the nominal 25/32" slack of a Type E coupler may seem small in the context of EOCC equipped cars having 10, 15 or 18 inches of travel. By contrast, that difference, 13/32", seems proportionately larger when viewed in the context of the approximately 11/16" buff compression (at 700,000 lbs.) of Mini-BuffGear. It should be noted that there are many different styles of Type E and Type F couplers, whether short or long shank, whether having upper or lower shelves, as described in the Cyclopedia, supra. There is a Type E/F having a Type E coupler head and a Type F shank. There is a Type E50ARE knuckle which reduces slack from 25/32 to 20/32". Type F herein is intended to include all variants of the Type F series, and Type E herein is intended to include all variants of the Type E series having 20/32" of slack or more.

Another way to reduce slack action in the draft gear is to employ stiffer draft gear. Short travel draft gear are presently available. As noted above, most M-901-G draft gear have an official rating travel of 2¾" to 3¼"under a buff load of 500,000 lbs. Mini-BuffGear, as produced by Miner Enterprises Inc., of 1200 State Street, Geneva Ill., appears to have a displacement of less than 0.7 inches at a buff load of over 700,000 lbs., and a dynamic load capacity of 1.25 million pounds at 1 inch travel. This is nearly an order of magnitude more stiff than some M-901-G draft gear. Miner indicates that this "special BuffGear gives drawbar equipped rail cars and trains improved lading protection and train handling", and further, "[The resilience of the Mini-BuffGear] reduces the tendency of the draw bar to bind while negotiating curves. At the same time, the Mini-BuffGear retains a high pre-load to reduce slack action. Elimination of slack between coupler heads, plus Mini-Buff Gear's high pre-load and limited travel, provide ultralow slack coupling for multiple-unit well cars and drawbar connected groups of unit train coal cars." Notably, unlike vehicle carrying rail cars, coal is unlikely to be damaged by the use of short travel draft gear.

In addition to M-901-G draft gear, and Mini-BuffGear, it is also possible to obtain draft gear having less than 1¾ inches of deflection at 400,000 lbs., one type having about 1.6 inches of deflection at 400,000 lbs. This is a significant difference from most M-901-G draft gear.

As noted above, auto rack rail road cars are end loaded. In circus loading, the vehicles are driven onto the rail road cars from one end. Each vehicle can be loaded in sequence by driving, or backing, along the decks of the rail road car units. The gaps between successive rail car units are spanned by bridge plates that permit vehicles to be driven from one rail car unit to the next. Although circus loading is common for a string of cars, end-loading can be used for individual rail car units, or multiple unit rail road cars, as may be.

From time to time some rail road cars are disconnected, and others are joined to the train. Traditionally, a pair of cars to be joined at a coupler are each equipped with one bridge plate permanently mounted on a hinged connection on one side of the car, typically the left hand side. In this arrangement the axis of the hinge is horizontal and transverse to the longitudinal centerline of the rail car.

In existing cars of this type, the bridge plate of each car at the respective coupled end is lowered, like a draw bridge, into a generally horizontal arrangement to mate with the adjoining car to permit loading and unloading. Each plate provides one side of the path so that the co-operative effect of the two plates is to provide a pair of tracks along which a vehicle can roll. When loading is complete, the bridge plates are pivoted about their hinges to a generally vertical, or raised, position, and locked in place so that they cannot fall back down accidentally.

It would be advantageous to have a bridge plate that can be moved to a storage, or stowed, position, with less lifting. A rail road car may sometimes be an internal car, with its bridge plates extended to neighbouring cars, and at other times the rail road car may be an "end" car at which the unit train is either (a) split for loading and unloading; (b) coupled to the locomotive; or (c) coupled to another type of rail road car. In each case, the bridge plate at the split does not need to be in an extended "drive-over" position, and should be in a stowed position. Therefore it is advantageous to have a rail car with bridge plates that can remain in position during operation as an internal car in a unit train, and that can also be stowed as necessary when the car is placed in an end or split position.

SUMMARY OF THE INVENTION

In an aspect of the invention there is an autorack rail road car. It has a railcar body supported for rolling motion in a longitudinal direction. The body has a first end, a second end, and at least a first deck and a second deck for carrying automobiles extending between the first and second ends. The second deck is mounted above the first deck. The first and second decks are end loadable to permit circus loading thereof. A draft gear is mounted to the railcar at the first end, and a releasable coupler is mounted to the draft gear. The draft gear has a deflection of less than 2 ½ inches under a buff load of 500,000 lbs.

In an additional feature of that aspect of the invention, the draft gear has less than 1¾ inches deflection at 400,000 lbs. buff load. In another additional feature, the draft gear has less than 1 inch deflection at 700,000 lbs. buff load. In still another additional feature, the draft gear is Mini-buff gear. In still yet another additional feature, the releasable coupler is operable to form a coupling having less than 25/32 inches of slack. In still yet another additional feature, the releasable coupler is operable to form a coupling having less than 20/32 inches of slack. In a further additional feature, the coupling has between 0 and ⅜ inches of slack. In still a further additional feature, the coupling is slackless. In an additional feature of that aspect of the invention, the releasable coupler is chosen from set of couplers consisting of: (a) AAR Type F couplers; (b) AAR Type H couplers; and (c) AAR Type CS couplers.

In another additional feature, the body is a first rail car body, and the auto rack rail road car is a multi-unit rail road car having at least a second rail car body joined to the first rail car body by a connection chosen from the set of connections consisting of (a) an articulated connector; and (b) a drawbar. In still another additional feature, the body is a first rail car body, and the auto rack rail road car is a multi-unit rail road car having at least a second rail car body joined to the first rail car body by an articulated connector. In yet another additional feature the rail road car has a bridge plate mounted to the first end of the body. The bridge plate is movable to a lengthwise orientation relative to the body to permit wheeled vehicles to be conducted between the first deck and a corresponding deck of an adjacently coupled auto rack rail road car. The bridge plate is movable to a cross-wise position relative to the body. In a further additional feature, the bridge plate is pivotable between the lengthwise orientation and the cross-wise orientation.

In another additional feature, the rail road car has a transition plate mounted between the main first deck and the bridge plate. The transition plate has an upwardly facing surface over which wheeled vehicles can be conducted between the bridge plate and the deck.

In yet another additional feature, the rail car body includes at least one door for controlling access to the interior of the rail road car, and the door has a ladder mounted thereto to permit access to the second deck when the door is in an open position. In a further additional feature of that aspect of the invention, the door is a radial arm door. The door has an outwardly facing surface, and the ladder is mounted on the outwardly facing surface.

In another aspect of the invention, there is an auto rack rail road car. It has a rail car body supported for rolling motion in a longitudinal direction. The body has a first end, a second end, and at least a first deck and a second deck for carrying automobiles extending between the first and second ends. The second deck is mounted above the first deck. The first and second decks are end loadable to permit circus loading thereof. A draft gear is mounted to the railcar at the first end and a releasable coupler is mounted to the draft gear. The coupler has less longitudinal free slack than an AAR Type E coupler.

In another aspect of the invention, there is an auto rack rail road car. It has a railcar body supported for rolling motion in a longitudinal direction. The body has a first end, a second end, and at least a first deck and a second deck for carrying automobiles extending between the first and second ends. The second deck is mounted above the first deck. The first and second decks are end loadable to permit circus loading thereof. A draft gear is mounted to the railcar at the first end, and a releasable coupler is mounted to the draft gear. A pair of left and right hand radial arm doors are mounted to the first end of the rail car body. The doors are operable to control access to the decks of the auto rack rail road car. The doors are movable to an open position to permit loading of vehicles on the decks. At least one of the doors has a deck access apparatus mounted thereto by which personnel can ascend the second deck.

In an additional feature of that aspect of the invention, the deck access apparatus is a ladder. In another additional feature, the radial arm doors have an external surface facing away from the decks, and the deck access apparatus includes footholds mounted to the external surface of one, or both, of the doors. In still another additional feature, the radial arm doors have an external surface facing away from the decks, and the deck access apparatus includes ladder rungs mounted to the external surface of one of the doors.

In another aspect of the invention, there is a combination comprising a first auto rack rail road car for carrying wheeled vehicles and a second auto rack rail road car for carrying wheeled vehicles. The first auto rack rail road car has a first coupler end, and a first releasable coupler mounted thereto. The second auto rack rail road car has a second coupler end, and a second releasable coupler mounted thereto. The first and second releasable couplers are mated to form a coupling. The first auto rack rail road car has a first deck upon which wheeled vehicles can be conducted, and another deck mounted thereabove upon which wheeled vehicles can be conducted. The second auto rack rail road car has a second deck upon which wheeled vehicles can be conducted, and an additional deck mounted thereabove upon which wheeled vehicles can be conducted. The first and second decks are longitudinally separated, a gap being defined therebetween. The first coupler end of the first rail road car has at least a first bridge plate mounting fitting. The second coupler end of the second rail road car has at least a second bridge plate mounting fitting. The first and second bridge plate mounting fittings are operable to engage bridge plates for spanning the gap to permit wheeled vehicles to be conducted between the first deck and the second deck; and the first rail road car has first draft gear mounted to the first end of the rail road car. The second rail road car has second draft gear mounted to the second end of the second rail road car. The first and second draft gears each have less than 2½ inches of travel at 500,000 lbs. buff load.

In an additional feature of that aspect of the invention, the first and second couplers are chosen from the set of couplers consisting of: (a) AAR Type E couplers; (b) AAR Type H couplers; and (c) AAR Type CS couplers. In another additional feature, the coupling has between 0 and ⅜ inches of slack. In still another additional feature, the coupling is slackless. In yet another additional feature, the first draft gear and the second draft gear each have a travel in buff less than 1 inch under 700,000 lbs. load. In a further additional feature, the first draft gear and the second draft gear each have a travel in buff between ⅝ and ¾ inches under 700,000 lbs. load. In yet a further additional feature, the first draft gear and the second draft are each Mini-BuffGear. In another additional feature, a bridge plate is mounted to each of the first and second bridge plate mounting fittings in a first position spanning the gap. In still another additional feature, each bridge plate is movable from the first position to a cross-wise stowed position relative to one of the rail road cars.

In still yet another additional feature, a bridge plate is mounted to the first end of the first rail car body, and the bridge plate is movable to a cross-wise stowed position relative to the first end of the first rail car body.

DETAILED DESCRIPTION OF THE INVENTION

Figure 1A:
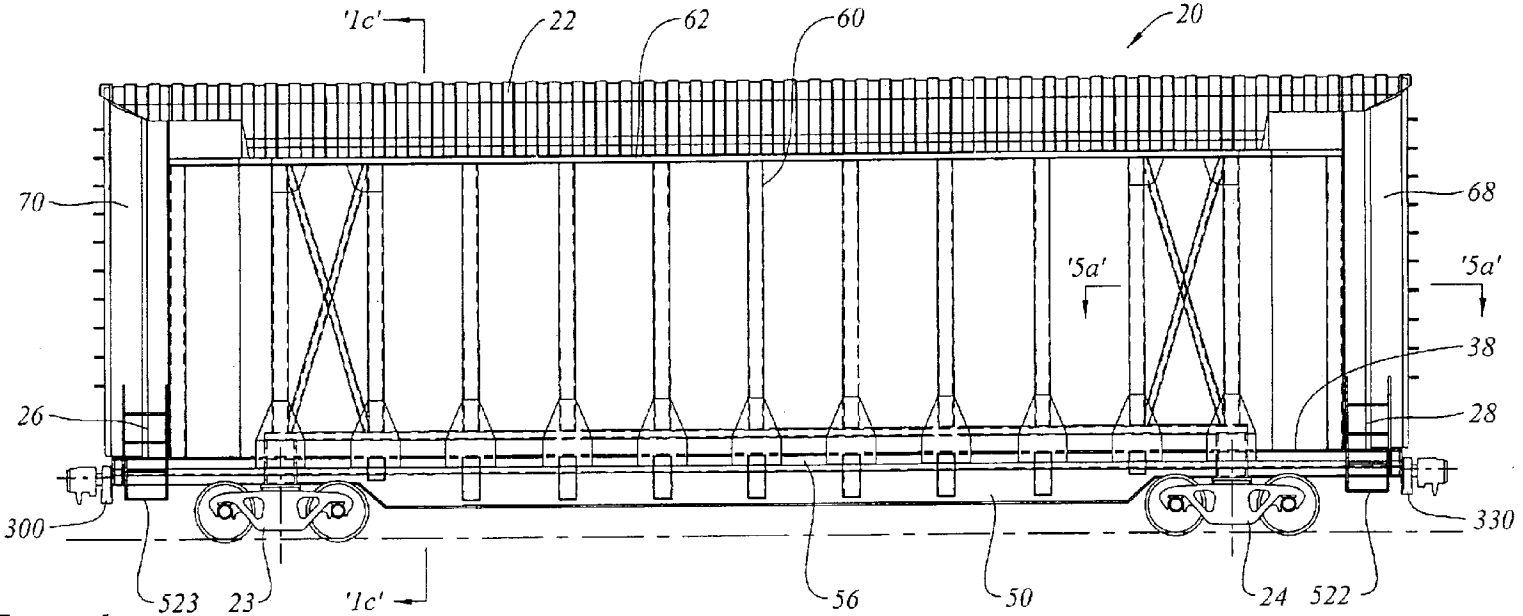
FIG. 1*a* shows a side view of a single unit auto rack rail road car.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit, indicated as CL-Rail Car. The term "longitudinally inboard", or "longitudinally outboard" is a distance taken relative to a mid-span lateral section of the car, or car unit. Pitching motion is angular motion of a rail car unit about a horizontal axis perpendicular to the longitudinal direction. Yawing is angular motion about a vertical axis. Roll is angular motion about the longitudinal axis.

FIGS. 1*a*, 2*a*, 2*b*, 3*a*, 3*b*, 4*a*, 4*b* and 4*c* show different types of auto rack rail road car, all sharing similar structural features. FIG. 1*a* (side view) shows a single unit autorack rail road car, indicated generally as 20. It has a rail car body 22 supported for rolling motion in the longitudinal direction (i.e., along the rails) upon a pair of rail car trucks 23 and 24 mounted at main bolsters at either of the first and second ends 26, 28 of rail car body 22. Body 22 has a housing structure 30, including a pair of left and right hand sidewall structures 32, 34 and a canopy, or roof 36 that co-operate to define an enclosed lading space. Body 22 has staging in the nature of a main deck 38 running the length of the car between first and second ends 26, 28 upon which wheeled vehicles, such as automobiles can be conducted. Body 22 can have staging in either a bi-level configuration, as shown in FIG. 1*c*, in which a second, or upper deck 40 is mounted above main deck 38 to permit two layers of vehicles to be carried; or a tri-level configuration, as in FIG. 1*d*, in which a mid-level deck 42 and a top deck 44 are mounted above each other, and above main deck 38 to permit three layers of vehicles to be carried. The staging, whether bi-level or tri-level, is mounted to the sidewall structures 32, 34. Each of the decks defines a roadway, trackway, or pathway, by which wheeled vehicles such as automobiles can be conducted between the ends of rail road car 20.

A through center sill 50 extends between ends 26, 28. A set of cross-bearers 52, 54 extend to either side of center sill 50, terminating at side sills 56, 58. Main deck 38 is supported above cross-bearers 52, 54 and between side sills 56, 58. Sidewall structures 32, 34 each include an array of vertical support members, in the nature of posts 60, that extend between side sills 56, 58, and top chords 62, 64. A corrugated sheet roof 66 extends between top chords 62 and 64 above deck 38 and such other decks as employed. Radial arm doors 68, 70 enclose the end openings of the car, and are movable to a closed position to inhibit access to the interior of car 20, and to an open position to give access to the interior. Each of the decks has bridge plate fittings (middle and upper deck fittings not shown) to permit bridge plates to be positioned between car 20 and an adjacent car when doors 68 or 70 are opened to permit circus loading of the decks.

Two-Unit Auto Rack Car

Figure 2A:
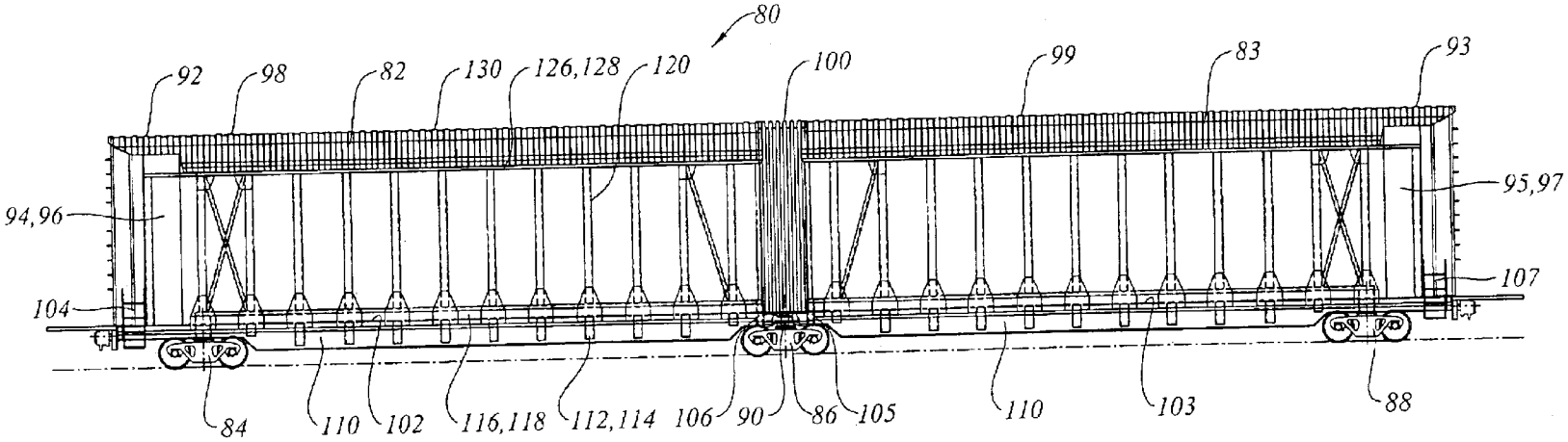
FIG. 2*a* shows a side view of a two unit auto rack rail road car.

Similarly, FIG. 2*a* shows a two unit autorack rail road car, indicated generally as 80. It has a first rail car body 82, and a second rail car body 83, both supported for rolling motion in the longitudinal direction (i.e., along the rails) upon rail car trucks 84, 86 and 88. Rail car trucks 84 and 88 are mounted at main bolsters at respective coupler ends of the first and second rail car bodies 82 and 83. Truck 86 is mounted beneath articulated connector 90 by which bodies 82 and 83 are joined together. Each of bodies 82 and 83 has a housing structure 92, 93, including a pair of left and right hand sidewall structures 94, 96 (or 95, 97) and a canopy, or roof 98 (or 99) that define an enclosed lading space. A bellows structure 100 links bodies 82 and 83 to discourage entry by vandals or thieves.

Each of bodies 82, 83 has staging in the nature of a main deck 102 (or 103) running the length of the car unit between first and second ends 104, 106 (105, 107) upon which wheeled vehicles, such as automobiles can be conducted. Each of bodies 82, 83 can have staging in either a bi-level configuration, as shown in FIG. 1*c*, or a tri-level configuration, as in FIG. 1*d*, and described above.

Other than brake fittings, and other minor fittings, car bodies 82 and 83 are substantially the same, differing only in that car body 82 has a pair of female side-bearing arms adjacent to articulated connector 90, and car body 83 has a co-operating pair of male side bearing arms adjacent to articulated connector 90.

Each of car bodies 82 and 83 has a through center sill 110 that extends between ends 104, 106 (105, 107). A set of cross-bearers 112, 114 extend to either side of center sill 110, terminating at side sills 116, 118. Main deck 102 (or 103) is supported above cross-bearers 112, 114 and between side sills 116, 118. Sidewall structures 94, 96 and 95, 97 each include an array of vertical support members, in the nature of posts 120, that extend between side sills 116, 118, and top chords 126, 128. A corrugated sheet roof 130 extends between top chords 126 and 128 above deck 102 and such other decks as employed.

Radial arm doors 68, 70 enclose the coupler end openings of car bodies 82 and 83 of rail road car 80, and are movable to respective closed positions to inhibit access to the interior of rail road car 80, and to respective open positions to give access to the interior thereof. Each of the decks has bridge plate fittings (upper deck fittings not shown) to permit bridge plates to be positioned between car 80 and an adjacent auto rack rail road car when doors 68 or 70 are opened to permit circus loading of the decks.

Three or More Unit Auto Rack

Figure 3B:
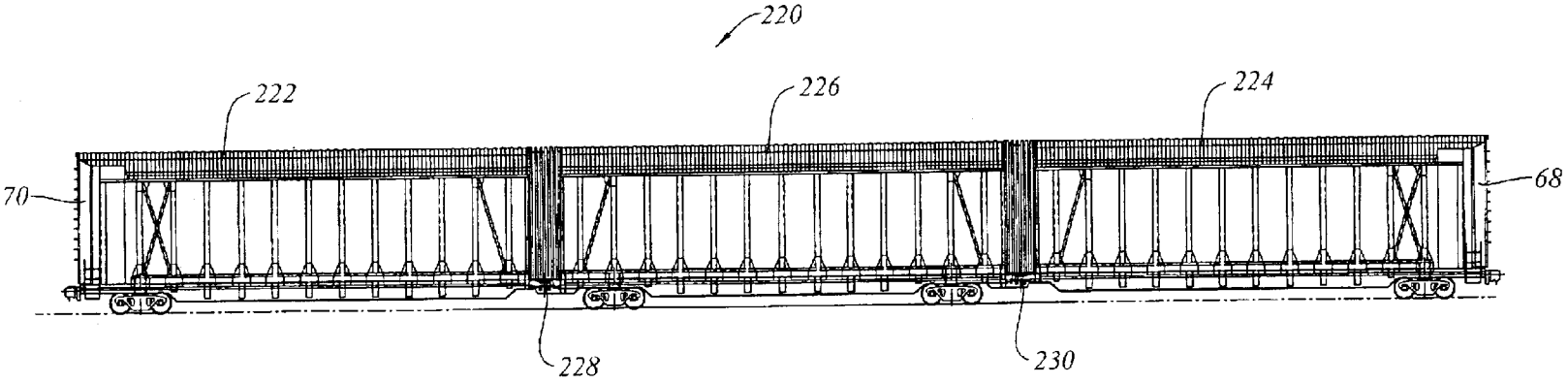
FIG. 3*b* shows a side view of an alternate three unit auto rack rail road car to the articulated rail road unit car of FIG. 3*a*, having cantilevered articulations.
Figure 3A:
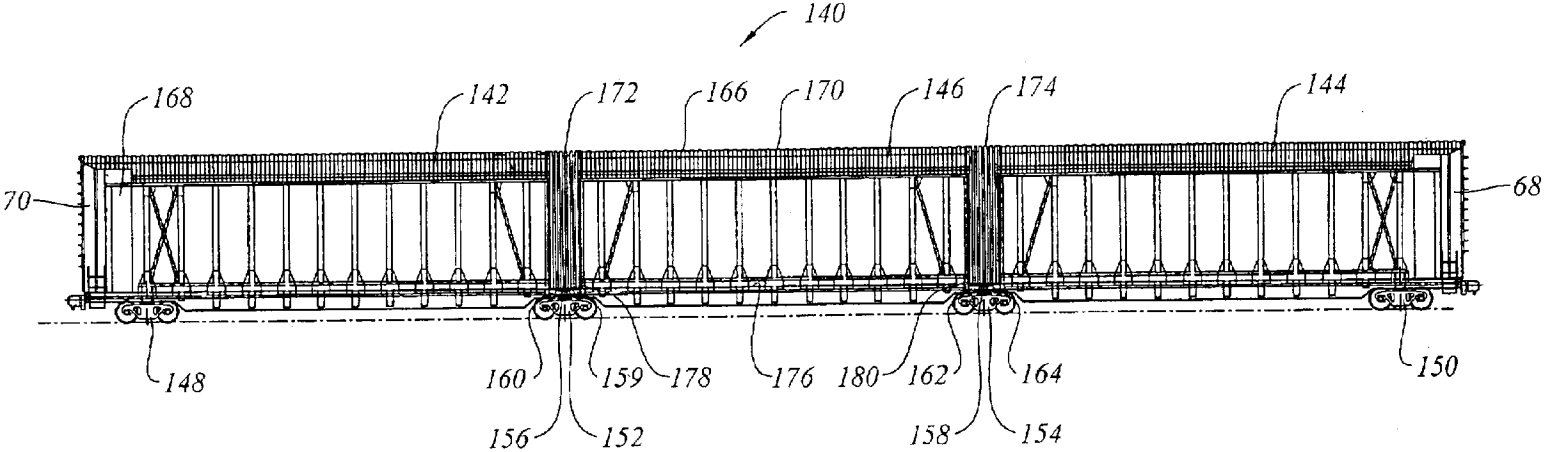
FIG. 3*a* shows a side view of a three unit auto rack rail road car.

FIG. 3*a* shows a three unit autorack rail road car, generally as 140. It has a first rail car body 142, and a second rail car body 144, and an intermediate rail car body 146 between rail car bodies 142 and 144. Rail car bodies 142, 144 and 146 are supported for rolling motion in the longitudinal direction (i.e., along the rails) upon rail car trucks 148, 150, 152, and 154. Rail car trucks 148 and 150 are mounted at main bolsters at respective coupler ends of the first and second rail car bodies 142 and 144. Trucks 152 and 154 are mounted beneath respective articulated connectors 156 and 158 by which bodies 142 and 144 are joined to body 146. For the purposes of this description, body 142 is the same as body 82, and body 144 is the same as body 83. Rail car body 146 has a male end 159 for mating with the female end 160 of body 142, and a female end 162 for mating with the male end 164 of rail car body 144.

Body 146 has a housing structure 166 that includes a pair of left and right hand sidewall structures 168 and a canopy, or roof 170 that co-operate to define an enclosed lading space. Bellows structures 172 and 174 link bodies 142, 146 and 144, 146 respectively to discourage entry by vandals or thieves.

Body 146 has staging in the nature of a main deck 176 running the length of the car unit between first and second ends 178, 180 defining a roadway upon which wheeled vehicles, such as automobiles can be conducted. Body 146 can have staging in either a bi-level configuration or a tri-level configuration, to co-operate with the staging of bodies 142 and 144.

Other than brake fittings, and other minor fittings, car bodies 142 and 144 are substantially the same, differing only in that car body 142 has a pair of female side-bearing arms adjacent to articulated connector 156, and car body 144 has a co-operating pair of male side bearing arms adjacent to articulated connector 158.

Figures 4A, 4B, 4C:
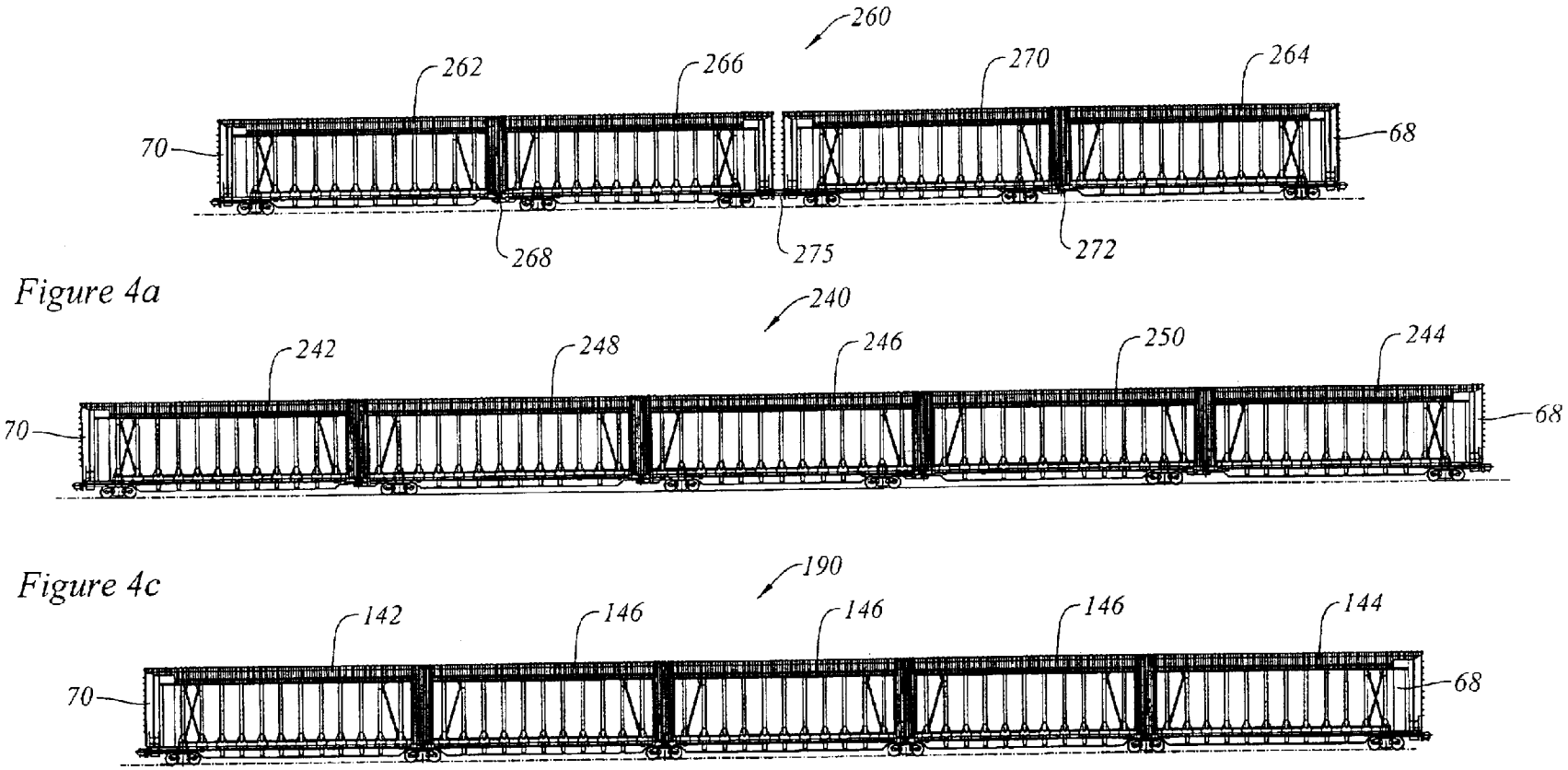
FIG. 4*a* shows a side view of a four unit auto rack rail road car connected with a draw bar.
FIG. 4*b* shows a side view of a five unit articulated auto rack rail road car.
FIG. 4*c* shows a side view of a five unit articulated auto rack rail road car with cantilevered articulations.

Other articulated auto-rack cars of greater length can be assembled by using a pair of end units, such as male and female end units 82 and 83, and any number of intermediate units, such as intermediate unit 146, as may be suitable. In that sense, rail road car 140 is representative of multi-unit articulated rail road cars generally. A five pack articulated rail road car of this construction is shown in FIG. 4*b* as 190.

Alternate Configurations

Figure 2B:
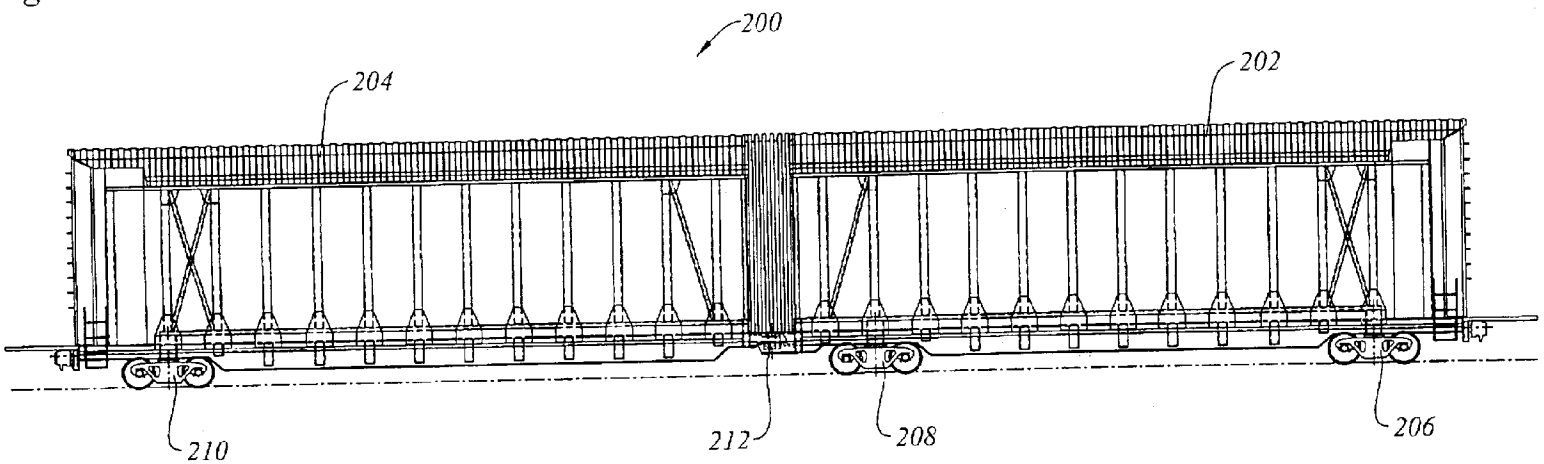
FIG. 2*b* shows a side view of an alternate auto rack rail road car to that of FIG. 2*a*, having a cantilevered articulation.

Four other alternate configurations of multi-unit rail road cars are shown in FIGS. 2*b*, 3*b*, 4*a* and 4*c*. In FIG. 2*b*, a two unit articulated auto-rack rail road car is indicated generally as 200. It has first and second rail car bodies 202, 204 supported for rolling motion in the longitudinal direction by three rail road car trucks, 206, 208 and 210 respectively. Rail car bodies 202 and 204 are joined together at an articulated connector 212. In this instance, while rail car bodies 202 and 204 share the same basic structural features of rail car body 22, in terms of a through center sill, cross-bearers, side sills, walls and canopy, and vehicles decks, rail car body 202 is a "two-truck" body, and rail car body 204 is a single truck body. That is, rail car body 202 has main bolsters at both its first, coupler end, and at its second, articulated connector end, the main bolsters being mounted over truck 206 and 208 respectively. By contrast, rail car body 204 has only a single main bolster, at its coupler end, mounted over truck 210. Articulated connector 212 is mounted to the end of the respective center sills of rail car bodies 202 and 204, longitudinally outboard of rail car truck 208. The use of a cantilevered articulation in this manner, in which the pivot center of the articulated connector is offset from the nearest truck center, is described more fully in my co-pending U.S. patent application Ser. No. 09/614,815 for a Rail Road Car with Cantilevered Articulation filed Jul. 12, 2000, incorporated herein by reference, and may tend to permit a longer car body for a given articulated rail road car truck center distance as therein described.

FIG. 3*b* shows a three-unit articulated rail road car 220 having first end unit 222, second end unit 224, and intermediate unit 226, with cantilevered articulated connectors 228 and 230. End units 222 and 224 are single truck units of the same construction as car body 204. Intermediate unit 226 is a two truck unit having similar construction to car body 202, but having articulated connectors at both ends, rather than having a coupler end. FIG. 4*c* shows an analogous five pack articulated rail road car having cantilevered articulations, shown generally as 240. It has single truck end units 242 and 244, being of the same structure as end units 222 and 224 respectively, a middle two-truck unit 246 having the same construction as unit 226, and a pair of inner (i.e., non-coupler end) single truck units 248 and 250 between units 242 and 246, and between units 244 and 246 respectively. Inner units 248 and 250 have the same basic construction as units 222 and 224, but have articulated connectors at both end, rather than having a coupler end. Many alternate configurations of multi-unit articulated rail road cars employing cantilevered articulations can be assembled by re-arranging, or adding to, the units illustrated.

FIG. 4*a* shows a four unit articulated rail road car 260 having a first coupler end unit 262, a second coupler end unit 264, a first single truck inner unit 266 joined by an articulated connector 268 to first end unit 262, and a second single inner truck unit 270 joined by an articulated connector 272 to second coupler end unit 264. In this way units 262 and 266, and units 264 and 270 form articulated pairs, similar to rail road car 200, but joined together with a draw bar 275 rather than a releasable coupling. As above, many other combinations of draw-bar connected auto-rack units can be assembled.

Figure 5A:
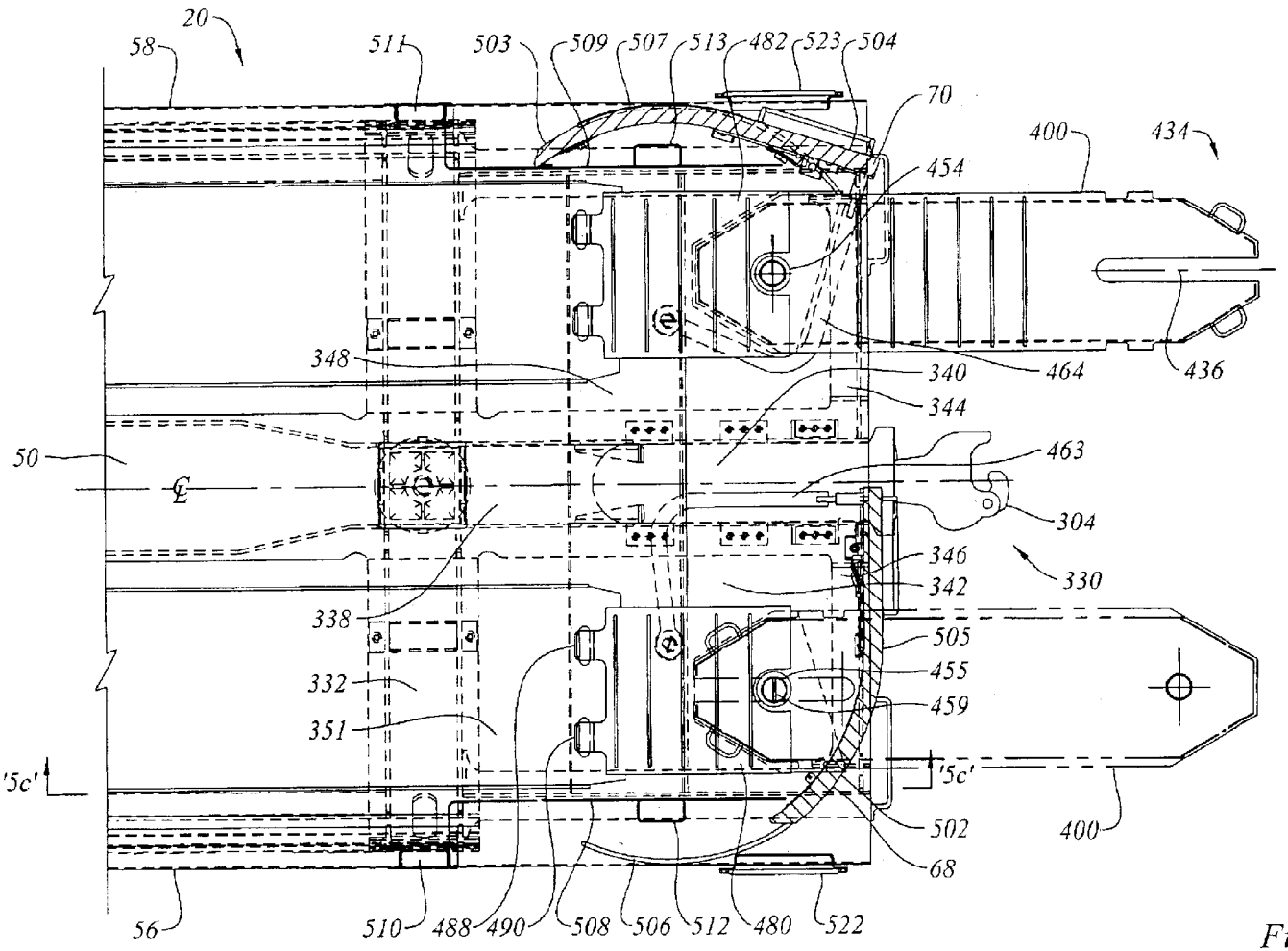
FIG. 5*a* is a partial sectional view from above of a coupler end of any of the rail road cars of FIGS. 1*a*, 2*a*, 2*b*, 3*a*, 3*b*, 4*a*, 4*b*, or 4*c* taken on '5*a*—5*a*' as indicated in FIG. 1*a;*
Figure 5B:
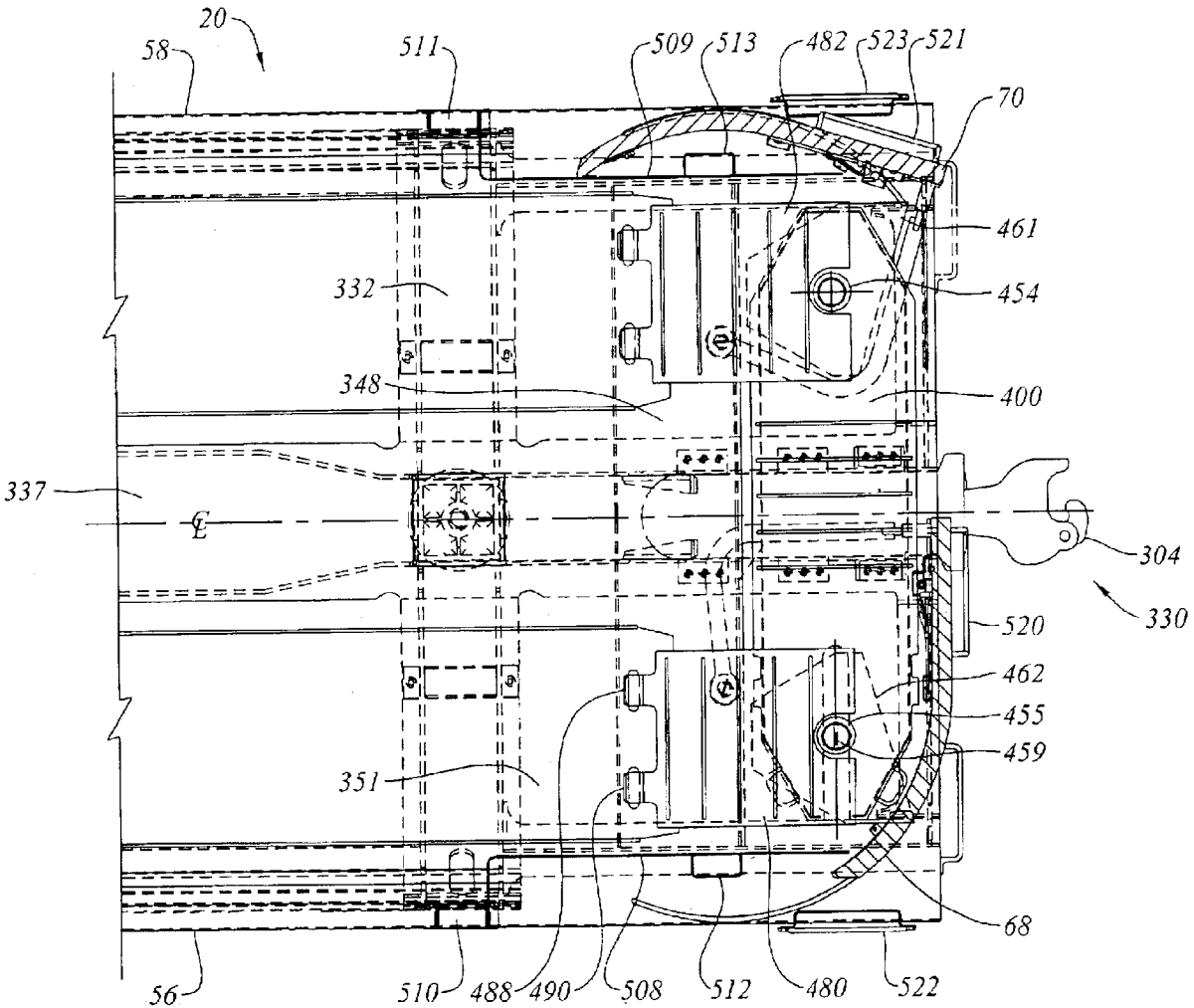
FIG. 5*b* shows the same car end view as FIG. 5*a*, with a bridge plate in a stowed, cross-wise position.

In each of the foregoing descriptions, each of rail road cars 20, 80, 140, 190, 200, 220 and 240 has a pair of first and second coupler ends at which it can be releasably coupled to other rail road cars, whether those coupler ends are part of the same rail car body, or parts of different rail car bodies of a multi-unit rail road car joined by articulated connections, draw-bars, or a combination of articulated connections and draw-bars. In that light, although the description of FIGS. 5*a* and 5*b* is made in the context of rail road car 20, the same description also applies to the coupler ends of each of rail road cars 80, 140, 190, 200, 220, and 240.

Figure 6B:
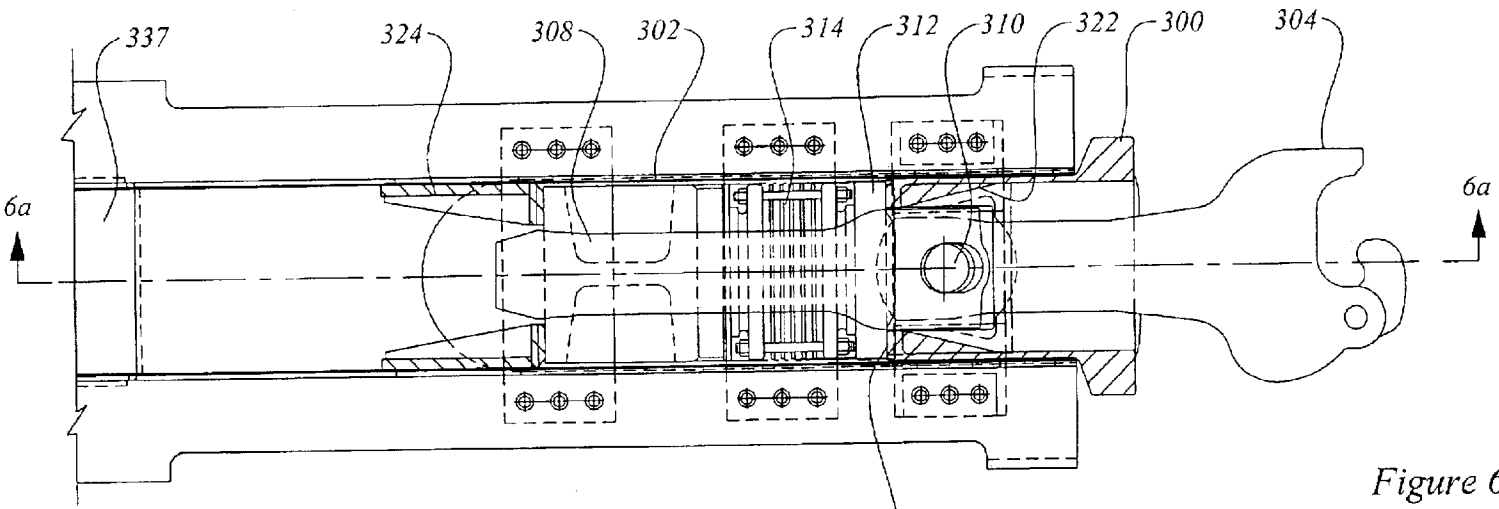
FIG. 6*b* shows a top view of the draft gear at the coupler end of FIG. 6*a* taken on '6*b*—6*b*' of FIG. 6*a;*
Figure 6A:
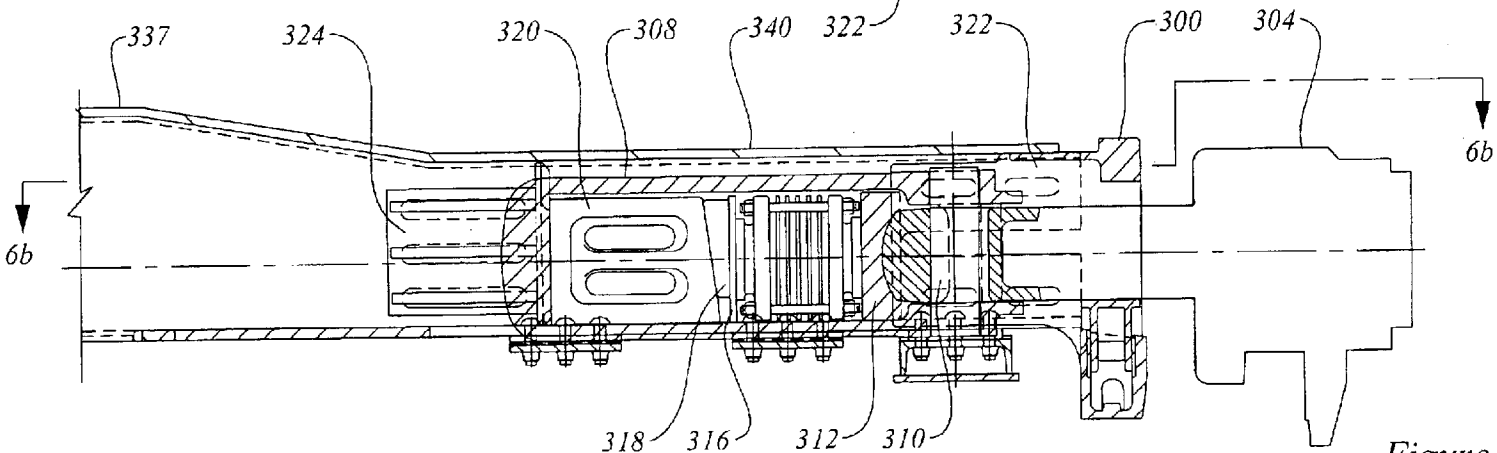
FIG. 6*a* is a partial side sectional view of the draft pocket of the coupler end of FIG. 5*a*, taken on '6*a*—6*a*'.
Figure 7A:
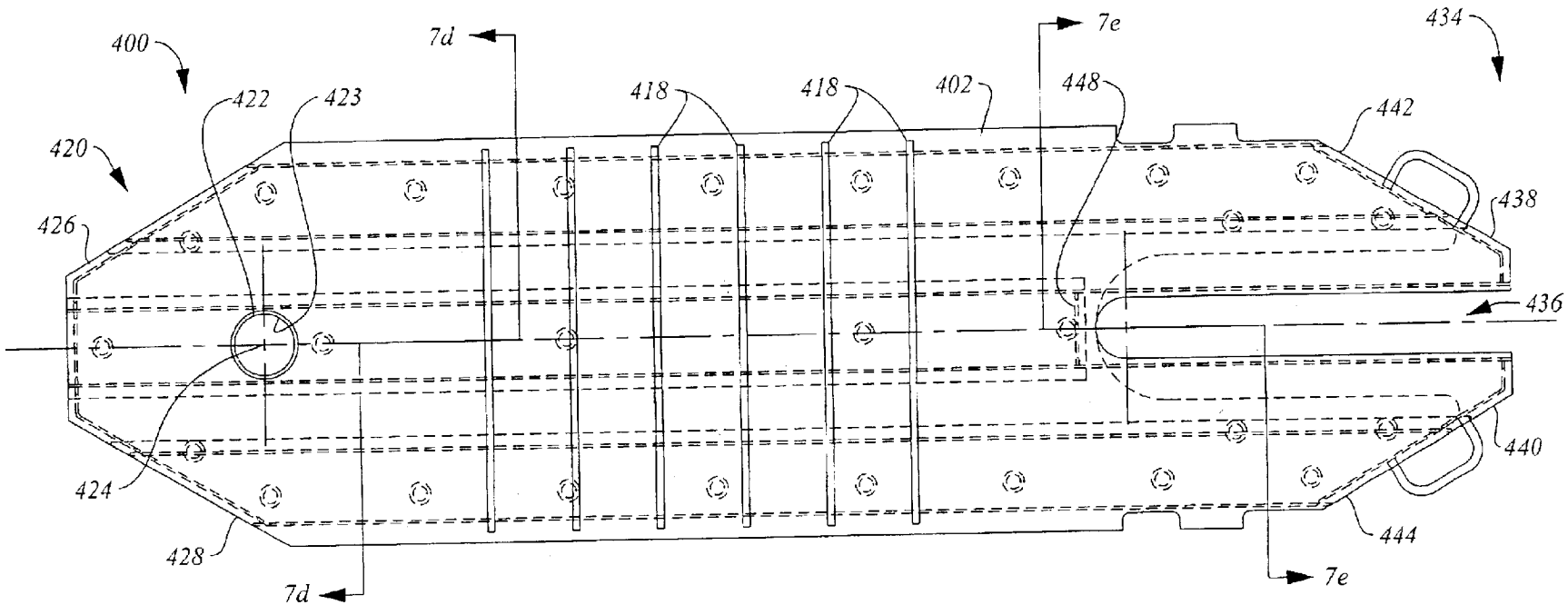
FIG. 7*a* shows a top view of a bridge plate for the rail car unit of FIG. 3*a;*
Figure 7B:
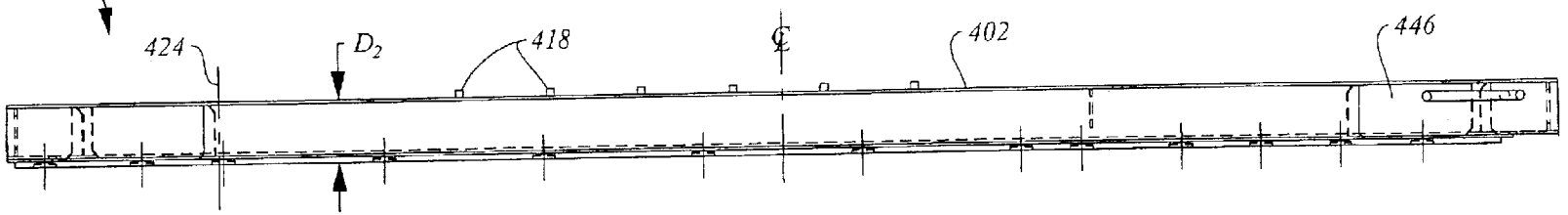
FIG. 7*b* shows a side view of the bridge plate of FIG. 7*a;*
Figures 7C, 7D, 7E:
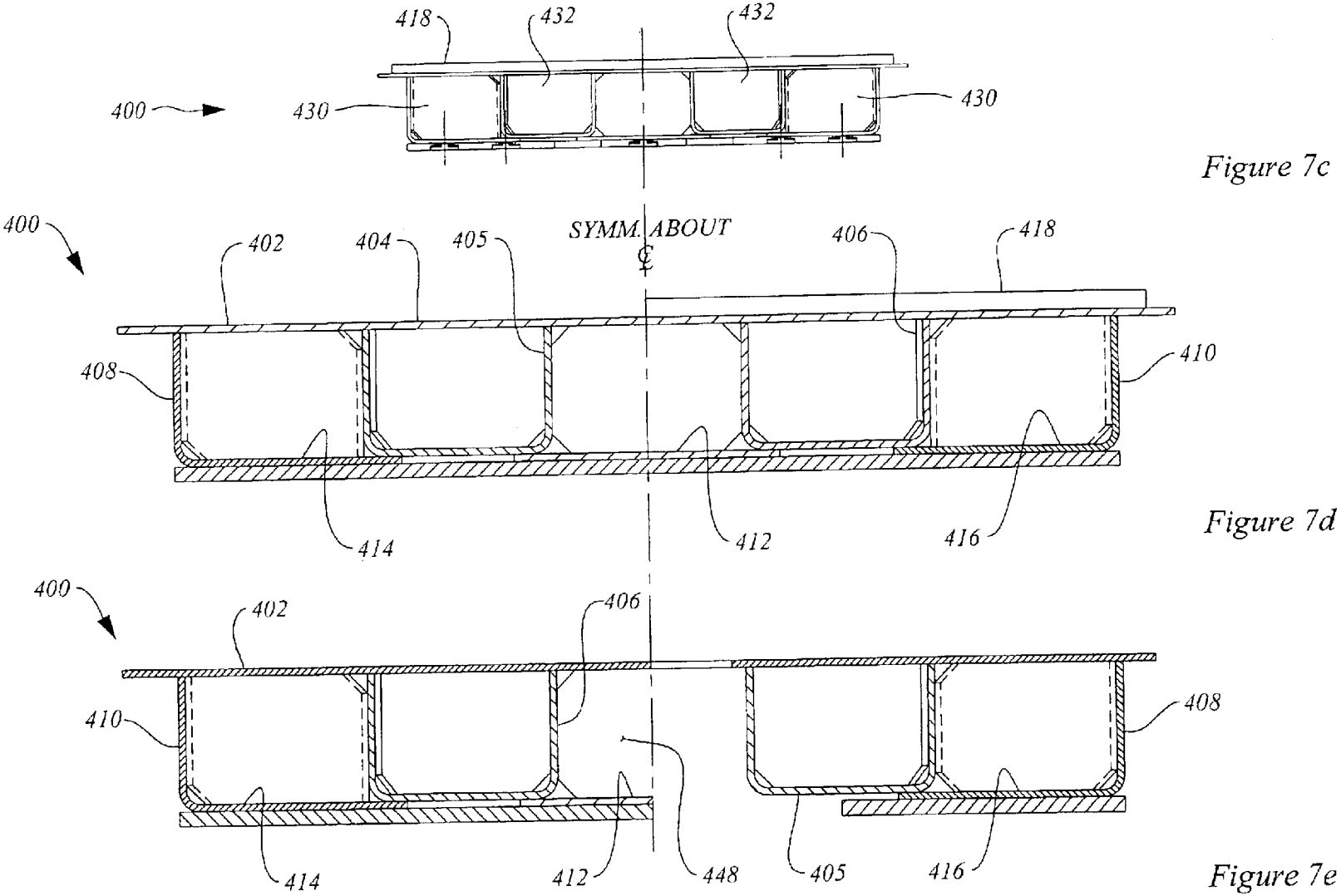
FIG. 7*c* shows an end view of the cross-section of the bridge plate of FIG. 7*a;*
FIG. 7*d* shows a section of the bridge plate of FIG. 7*a* taken on '7*d*—7*d*'.
FIG. 7*e* shows a section of the bridge plate of FIG. 7*a* taken on '7*e*—7*e*'.

FIGS. 6*a* and 6*b* show the draft gear at a first coupler end 300 of rail road car 20, coupler end 300 being representative of either of the coupler ends and draft gear arrangement of rail road car 20, and of rail road cars 80, 140, 190, 200, 220 and 240 more generally. Coupler pocket 302 houses a coupler indicated as 304. It is mounted to a coupler yoke 308, joined together by a pin 310. Yoke 308 houses a coupler follower 312, a draft gear 314 held in place by a shim (or shims, as required) 316, a wedge 318 and a filler block 320. Fore and aft draft gear stops 322, 324 are welded inside coupler pocket 302 to retain draft gear 314, and to transfer the longitudinal buff and draft loads through draft gear 314 and on to coupler 304. In the preferred embodiment, coupler 304 is an AAR Type F70DE coupler, used in conjunction with an AAR Y45AE coupler yoke and an AAR Y47 pin. In the preferred embodiment, draft gear 314 is a Mini-BuffGear such as manufactured by Miner Enterprises Inc, supra., or by the Keystone Railway Equipment Company, of 3420 Simpson Ferry Road, Camp Hill, Pa. As taken together, this draft gear and coupler assembly yields a reduced slack, or low slack, short travel, coupling as compared to an AAR Type E coupler with standard draft gear or hydraulic EOCC device. As such it may tend to reduce overall train slack, and may tend to reduce the range of travel to be accommodated by bridge plates 400, described below. In addition to mounting the Mini-BuffGear directly to the draft pocket, that is, coupler pocket 302, and hence to the structure of the rail car body of rail road car 20, (or of the other rail road cars noted above) the construction described and illustrated is free of other long travel draft gear, sliding sills and EOCC devices, and the fittings associated with them.

Mini-BuffGear has between ⅝ and ¾ of an inch in buff at a compressive force greater than 700,000 lbs. Other types of draft gear can be used that will give an official rating travel of less than 2½ inches under M-901-G, or if not rated, then a travel of less than 2.5 inches under 500,000 lbs. buff load. For example, while Mini-BuffGear is preferred, other draft gear is available having a travel of less than 1¾ inches at 400,000 lbs., buff load, one known type has about 1.6 inches of travel at 400,000 lbs., buff load. It is even more advantageous for the travel to be less than 1.5 inches at 700,000 lbs. buff load and, as in the embodiment of FIGS. 6*a* and 6*b*, preferred that the travel be at least as small as 1" inches or less at 700,000 lbs. buff load.

Similarly, while the AAR Type F70DE coupler is preferred, other types of coupler having less than the 25/32" (that is, less than about ¾ nominal slack of an AAR Type E coupler generally or the 20/32" slack of an AAR E50ARE coupler can be used. In particular, in alternative embodiments with appropriate housing changes where required, AAR Type F79DE and Type F73BE, with or without top or bottom shelves; AAR Type CS; or AAR Type H couplers can be used to obtain reduced slack relative to AAR Type E couplers.

At the coupler end, end portion 330, main center sill 50 of rail road car 20 becomes shallower, the bottom flange being stepped upwardly to a height suitable for being supported on truck 24. Side sills 56 and 58 also become shallower as the bottom flange curves upward to clear truck 24. Rail road car unit 20 has a laterally extending main bolster 332 at the longitudinal station of the truck center (CL Truck), and a parallel, laterally extending end sill 334 having left and right hand arms 335, 336 extending laterally between coupler pocket 302 and the side sills.

Figure 5C:
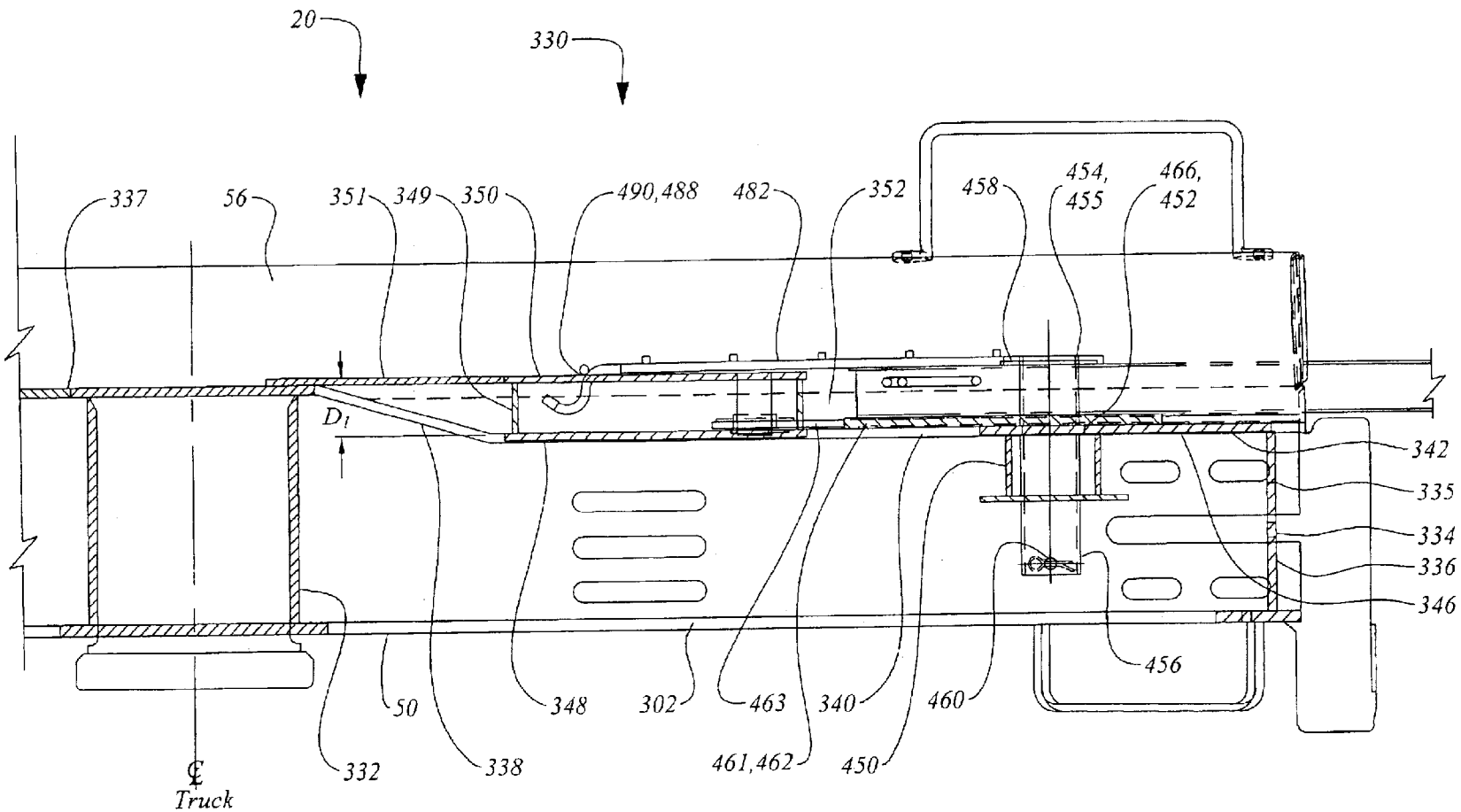
FIG. 5*c* shows a view through the coupler end of FIG. 5*a* taken on '5*c*—5*c*'.

As shown in FIGS. 5*a*, 5*b* and 5*c*, top flange 337 of center sill 50 has a downwardly sloping transition 338 longitudinally outboard of main bolster 332, and a level, horizontally extending portion 340 lying outboard thereof, such that the end portion of center sill 50 is stepped downward relative to the main portion of top flange 337 inboard of bolster 332. A bridge plate support member, in the nature of an outboard horizontal shelf portion 342, includes left and right hand plates 344, 346 that form upper flanges for, and extend longitudinally inboard of, arms 335 and 336 of end sill 334 to define bridge plate support members.

A laterally extending structural member, in the nature of a fabricated closed beam 348 is welded to horizontally extending portion 340 of center sill 50 between side sills 56 and 58. Beam 348 has vertical legs 349 extending upwardly of portion 340 and a horizontal back 350, lying flush with the level of top flange 337 at the longitudinal location of main bolster 332. Left and right hand deck plates 351 are welded to back 350 and extend to terminate at main bolster 332.

Plates 344 and 346 are flush with downwardly stepped horizontal portion 340 of top flange 337, and co-operate with portion 340 to define a continuous shelf across (i.e., extending cross-wise relative to) the end of rail road car 20, longitudinally outboard of the end of main deck 38 defined by the longitudinally outboard edge of beam 348. In this way a step, depression, shelf, or rebate, or recess 352 for accommodating (or for receiving) a bridge plate, is formed in the end of rail road car 20 adjacent to coupler 304, upon which bridge plate 400 can rest, as described below.

A gap spanning structural member, or beam, is indicated in the Figures as bridge plate 400. Bridge plate 400 is preferably of steel construction, but could be of aluminum, or suitable reinforced engineered plastics, to reduce the weight to be manipulated by rail yard crews. Bridge plate 400 has the construction of a rigid flanged beam, having a top flange, or sheet 402, upon whose upper surface 404 wheeled vehicles such as automobiles can be conducted. Sheet 402 is backed by a pair of spaced apart, longitudinally extending channel members 405 and 406, welded with toes against sheet 402. A pair of formed angles 408 and 410 are welded laterally outboard of channel members 405 and 406, and a plate 412 is welded to span the gap between the backs of channel members 405 and 406. In this way plate 412, the backs of channel members 405 and 406, and the horizontal legs 414 and 416 of formed angles 408 and 410 act as a bottom flange in opposition to the top flange, sheet 402, with the other legs and toes acting as vertical shear transfer webs. A traction enhancement means is provided to give bridge plate 400 a non-smooth, or roughened track, in the nature of laterally extending, parallel, spaced tread bars 418 welded to the mid-span portion of sheet 402.

At one end, defined as the proximal, or inboard end, 420, bridge plate 400 has a pivot fitting, in the nature of a pair of aligned holes 422, 423 formed in sheet 402 and plate 412 to define a hinge pin passage. The axis 424 of the passage formed through hole 422 is normal (i.e., perpendicular) to upper surface 404 of sheet 402, and, in use, is ideally vertical, or predominantly vertical given tolerance and allowance for yaw, pitch, and roll between the rail road cars. Proximal end 420 is chamfered as shown at 426, 428 and is boxed in with web members 430, 432. Although a mitre is preferred for simplicity of manufacture, either end of bridge plate 400 could have a rounded shape, rather than a mitre.

At the other end, defined to be the distal, or outboard end, 434, bridge plate 400 is bifurcated, having a linear expansion member in the nature of a longitudinally extending guideway, or slot, 436, defined between a pair of tines, or toes 438, 440, each having an external chamfer as shown at 442, 444. The distal ends of channel members 404, 406 are also boxed in at distal end 434 as shown at 446. A web member, in the nature of a gusset 448 is welded between the facing walls of channels 405 and 406, adjacent to the groin of slot 436, to encourage toes 438 and 440 to maintain their planar orientation relative to each other.

As shown in FIG. 5*a*, bridge plate 400 can be mounted in an employed, drive-over, or length-wise extended position, in which distal end 434 is located longitudinally outboard of end sill 334, and in which the longitudinal axis of bridge plate 400 is parallel to the longitudinal centerline axis of car unit 20 (on straight track, but otherwise depending on pitch and yaw between cars) to permit vehicles to be conducted between cars. Bridge plate 400 can also be mounted in a stowed, lateral, transverse or cross-wise position, as shown in FIG. 5*b*, in which the centerline of bridge plate 400 is perpendicular to the longitudinal centerline of car unit 20.

Shelf portion 342 has a first bore formed therein to one side of longitudinal centerline of unit 20. A pivot fitting, or mounting fitting, in the nature of a collar 450 is mounted flush with, or slightly shy of the upper surface of shelf portion 342, at a first location, indicated as bore 452, for alignment with through hole 422. A retaining member, in the nature of a hinge pin 454, is fabricated from a section of pipe 456 of a size permitting a loose fit within collar 450 to allow for roll, pitch and yaw between cars. Pipe 456 has a flange 458 mounted at one end, the proximal or upper end. Flange 458 bears on sheet 402 to prevent pipe 456 from falling though collar 450. Pin 454 also has a lifting fitting in the nature of an internal cross bar 459 mounted at the flanged end. Bar 459 is grasped to withdraw pin 454 (or 455, below). The distal or lower end of pipe 456 is slotted to accept a transverse pin 460, itself held in place by a locking member in the nature of a cotter pin, that prevents hinge pin 454 from unintentionally lifting out or collar 450. Shelf portion 342 also has an abutment, or stop, not shown, welded to the upper surface of plate 346 to prevent bridge plate 400 from being pivoted past the stowed position.

When hinge pin 454 is in place, bridge plate 400 is restricted, or constrained, within the limits of a loose fit, to a single degree of freedom relative to rail road car 20, namely pivotal motion about a vertical axis. In the preferred embodiment, nylon (t.m.) pads 461, 462 are mounted to shelf portion 342 and bear against the underside of bridge plate 400 to provide a bearing surface. Pads 461 and 462 are trimmed to allow for the motion of left and right hand radial arms 463 and 464 of doors 68 and 70. In alternative embodiments other types of relatively slippery, high density, or UHMW, polymer materials could be used.

Shelf portion 342 has a second bore formed therein offset to the other side of longitudinal underside of car unit 20. As shown in FIGS. 5*a* and 5*c*, another collar 450 is mounted to the underside of, and flush with (or, shy of) plate 344 of shelf portion 342 at a second location, indicated as bore 466, at the same longitudinal station as bore 452 for alignment with slot 436 when bridge plate 400 is in the lateral, or storage, position resting fully on shelf portion 342. Another hinge pin 455, of the same construction as pin 454 described above, is provided to secure bridge plate 400 in the stowed position, the distal end of pin 455 locating in bore 452 and the proximal end locating in slot 436 defined between toes 438, 440. When hinge pin 455 is removed, bridge plate 400 is able to pivot about the hinge formed by the co-operation of hinge pin 454, collar 450 and through hole 422.

Figure 1B:
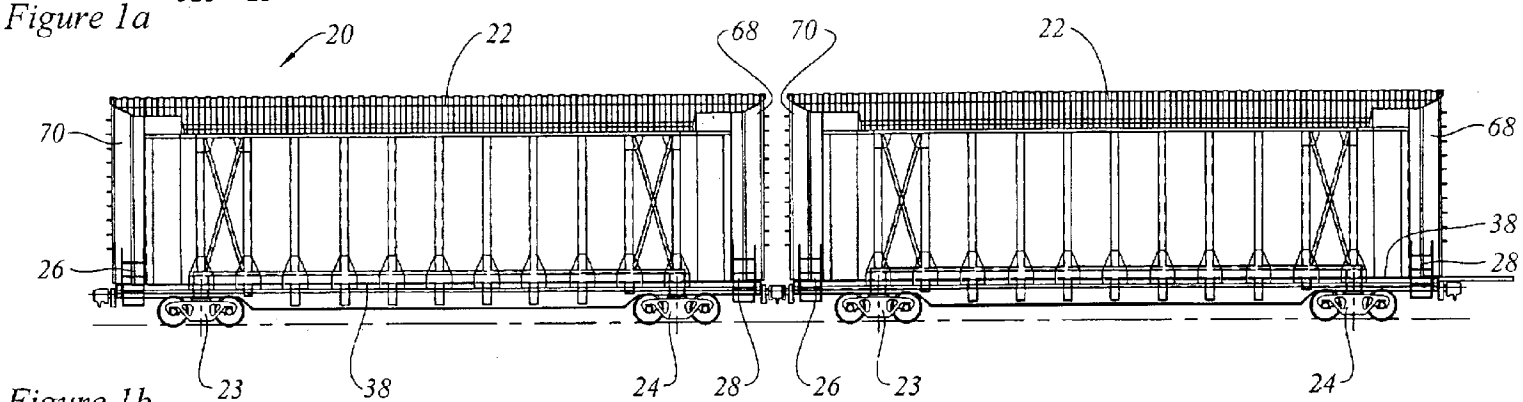
FIG. 1*b* shows a side view of two of the autorack rail road cars of FIG. 1*a* coupled together.
Figure 1D:
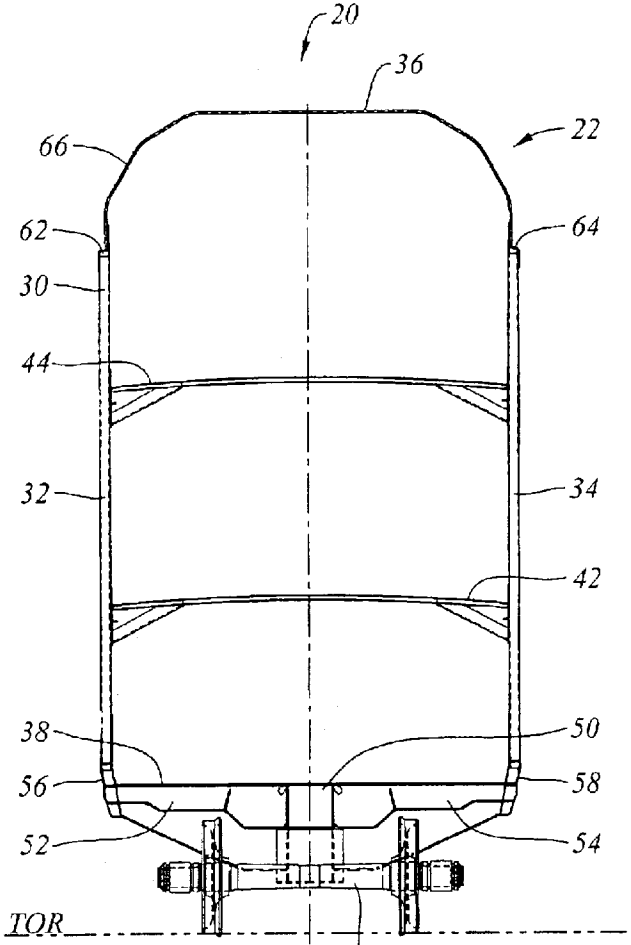
FIG. 1*d* shows an alternate view to that of FIG. 1*c*, of the auto rack rail road car of FIG. 1*a* in a tri-level configuration.
Figure 1C:
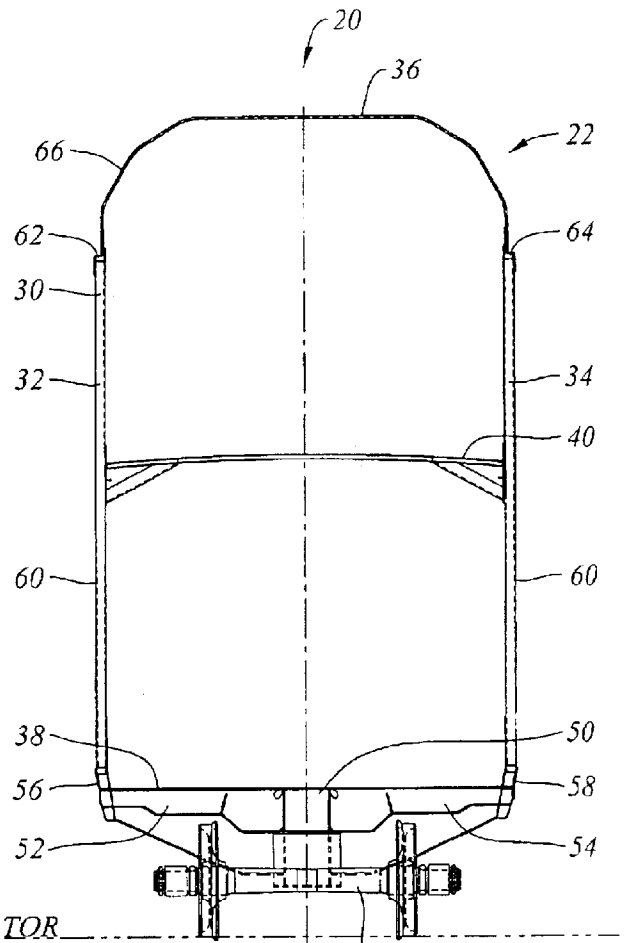
FIG. 1*c* shows a cross-sectional view of the auto-rack rail road car of FIG. 1*a* in a bi-level configuration taken on '1*c*—1*c*' of FIG. 1*a;*

When a bridge plate such as bridge plate 400 is in the extended (i.e., lengthwise, or longitudinal) position, and its distal end (or tip) engages the adjacent rail road car, such as car 21 in FIG. 1*b*, when positioned with doors open and prepared for loading or unloading, pin 455 is again used, this time to provide a positive, securing, retaining, indexing, or alignment member to the engaging fitting, namely slot 436. Slot 436 is then constrained, within the confines of a loose fit, to permit motion along a first linear degree of freedom, namely to slide as the gap between cars shortens and lengthens as adjacent rail car units yaw, or translate transversely, relative to each other, and a rotational degree of freedom relative to the locating pin, i.e., pin 455, of the adjacent car. As above, the loose fit of pin 455 in slot 436 allows for normal pitch and roll motion of the cars. The combination of a rotational degree of freedom at pin 454 of one rail road car, and both rotational and linear displacement at pin 455 of the other rail road car, accommodates both curving and transverse displacement of the coupler ends relative to each other. That is, the interaction of slot 436 with pin 455 provides both a pivot fitting for accommodating yawing motion of the adjacent rail road car, but also provides a linear expansion member for accommodating variation in distance between the respective vertical axes of pin 454 (and, collar 450) of one rail road car, e.g., car 20, and pin 455 (and its collar 450) of the adjacently coupled rail road car, e.g., car 21.

Figure 8A:
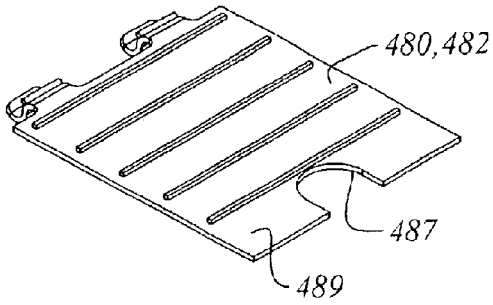
FIG. 8*a* shows an isometric view of a transition plate of the rail car of FIG. 5*a;*
Figure 8B:
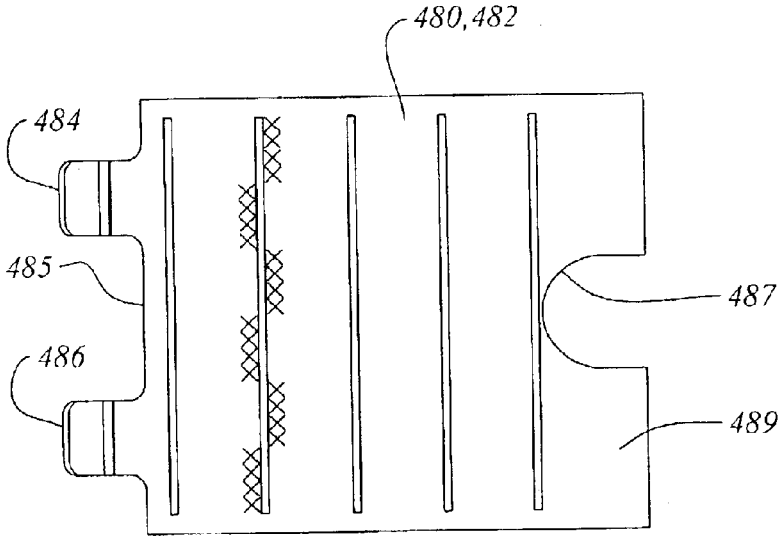
FIG. 8*b* shows a top view of the transition plate of FIG. 8*a*.
Figure 8C:
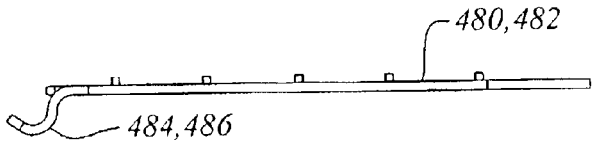
FIG. 8*c* shows a side view of the transition plate of FIG. 8*a*.

Left and right hand transition plates are shown in FIGS. 8*a*, 8*b*, and 8*c* as 480, 482. Each has pivot fittings in the nature of arcuate hinge tangs 484, 486 extending from proximal edge 485. Hinge tangs 484, 486 locate in corresponding apertures, namely rectangular slots 488, 490 (FIG. 5*a*) formed in back 350 of beam 348. Hinge tangs 484, 486 and slots 488, 490 co-operate to permit upward lifting of their distal tips by pivotal motion of each of transition plates 480, 482 about a horizontal pivot axis lying perpendicular to the longitudinal centerline of rail road car 20. As above, there is tolerance in the fit of tangs 484, 486 and slots 488, 490 to allow for normal railcar motion. Transition plates 480 and 482 cover the gap that could otherwise exist between the inboard, or proximal end of bridge plate 400 (on one side, i.e., 480) or the toes of the bridge plate of the adjoining rail car (on the other side, i.e., 482) and the end of deck 38 of rail road car 20. Transition plates 480, 482 each have a U-shaped central relief 487 formed in distal portion 489 to avoid fouling pin 454 (or 455).

In the preferred embodiment, the upper surface of bridge plate 400 is roughly flush with the level of the adjacent end of deck 38, as taken at the height of the upper surface of the top flange fabricated cross-beam 348 such that a generally level roadway is formed. It is possible to conduct wheeled vehicles from bridge plates 400 to deck 38 without the use of transition plates 480, 482, but is more advantageous to use transition plates. It is also not necessary that the depth of shelf portion 342 relative to the end of the deck, (i.e., the height of the step) indicated as $D_1$, be the same as the depth of bridge plate 400, indicated as $D_2$. It is advantageous that the height differential between the top of bridge plate 400 and the end of deck 38 be small, such as less than 1½ inches, and better still, less than ½ inch to reduce the potential bump. The severity of the bump is also reduced by the use of transition plates 480, 482, that permit a mismatch in height to be taken up over a modest longitudinal distance, rather than suddenly.

It is also possible to use a bridge plate support member other than shelf portion 342. For example, a cross-beam or cantilevered beam could be used, whether mounted to end sill 334, center sill 50, side sills 54, 56 or some combination thereof. Alternatively a pedestal could be employed having an upwardly protruding pin in place of pin 454, and an alternative form of second retainer in place of pin 455, such as one or more retractable abutments, whether spring loaded or otherwise in the manner of spring loaded detents, or a releasable hook or latch, could be used to similar effect. The use of a bridge plate kit including bridge plate 400 and pins 454 and 455 is advantageous since pins 454 and 455 are interchangeable, are used to provide motion tolerant retention of the proximal end (by pin 454) and distal end (by pin 455) of bridge plate 400 in either lengthwise or cross-wise positions, are relatively robust, and are of relatively simple fabrication.

On level track, the swinging of bridge plate 400 between length-wise and cross-wise positions occurs in the plane of shelf portion 342, that plane being a horizontal plane, such that rail yard personnel do not need to raise (or lower) the bridge plate to (or from) a vertical, or nearly vertical, position as was formerly common. Although the foregoing discussion is made in the context of rail road cars 20 and 21, it is understood that it will apply to rail road cars 80, 140, 190, 200, 220 and 240, and to such other rail road cars as with which they may be coupled, in like manner.

The process for changing bridge plate 400 from the length-wise position to the cross-wise position is relatively simple: the rail car is established in an uncoupled position by uncoupling the rail road cars and moving them apart, thus disengaging the distal tip of bridge plate 400 from the adjacent car, and establishing bridge plate 400 in the extended position. Pin 455 is removed, transition plate 480 is disengaged from bridge plate 400 by raising its distal portions clear of bridge plate 400. Plate 482 is also raised. Then bridge plate 400 is moved from the length-wise position to the cross-wise position. As noted, the step of moving includes swinging bridge plate 400 in the horizontal plane of portion 342 about the pivot mounting provided by the interaction of pin 454 in collar 450. This is followed by securing bridge plate 400 in place by reinserting pin 455 as a retainer, and by re-engaging transition plates 480, 482, as by lowering them to the overlapping position. The step of operating the cam cranks includes the step of turning them to bear against the transition plates.

Radial arm doors 68 and 70 each have an arcuate, outboard portion 502, 503 and an inboard, or tangent portion 504, 505. The outboard corner of portions 502, 503 is provided with a roller for following an arcuate track of constant radius 506, 507. The tangent portion is also constrained to follow a circular arc by dog-legged radial arm 463, 464. Similar radial arms (not shown) are mounted to the upper deck (of a bi-level car) or the top deck or roof (of a tri-level car) to constrain the door to motion along the desired circular arc. As shown, door 68 is in the closed position, and door 70 is in the open position, both doors being movable along the arcuate paths between respective open and closed positions, thereby controlling access to the internal space of the rail road car. In the open position the most longitudinally inboard edge of the arcuate portion of the door abuts a shear bay panel 508, 509 mounted between a vertical support referred to as the "number one post" indicated as 510, 511 and a longitudinally inboard vertical support referred to as the "number two post" 512, 513. The number one post stands laterally inboard relative to the number two post, and, in the open position doors 68 and 70 move to the outside of the shear bay panel. In the closed position the lower edge of doors 68 and 70 rides clear of bridge plate 400, with tolerance for normal train motion.

An upper deck access apparatus, in the nature of a ladder formed by an array of ladder rungs 520, 521 mounted to extend outwardly from the tangent portion of each of doors 68 and 70. When doors 68 and 70 are in their respective open positions, rungs 520, 521 lie generally in line with a deck level access ladder 522, 523 such that a person may climb from track level up ladder 522 (or 523) and onto rungs 520 (or 521). The inside face of the tangent portion is provide with a hand hold rung, or rungs, (not shown) suitable for a person standing on an upper, mid, or top deck.

Various embodiments of the invention have now been described in detail. Since changes in and or additions to the above-described best mode may be made without departing from the nature, spirit or scope of the invention, the invention is not to be limited to those details.

I claim:

1. A rail road car comprising:

a rail car body supported for rolling in a longitudinal direction;

said body having a first end and a second end;

said body having a housing structure including a pair of sidewalls, a roof and at least one deck;

said deck being mounted to said sidewalls;

said housing structure defining an enclosed lading space;

at least one door for controlling access to said enclosed space;

a draft gear mounted to said rail car at said first end, and a releasable coupler mounted to said draft gear;

said draft gear having a deflection of less than 2½ inches under a buff load of 500,000 Lbs.

2. The rail road car of claim 1 wherein said draft gear has less than 1¾ inches deflection at 400,000 Lbs. buff load.

3. The rail road car of claim 1 wherein said draft gear has less than 1 inch deflection at 700,000 Lbs. buff load.

4. The rail wed car of claim 1 wherein said draft gear is Mini-buff gear.

5. The rail road car of claim 1 wherein said releasable coupler is operable to form a coupling having less than 25/32 inches of slack.

6. The rail road car of claim 1 wherein said releasable coupler is operable to form a coupling having less than 20/32 inches of slack.

7. The rail road car of claim 1 wherein said coupler has between 0 and ⅜ inches of slack.

8. The rail road car of claim 1 wherein said coupler is slackless.

9. The rail road car of claim 1 wherein said releasable coupler is chosen from set of couplers consisting of: (a) AAR Type F couplets; (b) AAR Type H couplers; and (c) AAR Type CS couplers.

10. An auto rack rail road car comprising:

a rail car body supported for rolling motion in a longitudinal direction;

said body having a first end and a second end;

said body having a housing structure including a pair of sidewalls, a roof and at least one deck;

said deck being mounted to said sidewalls;

said housing structure defining an enclosed lading space;

at least one door for controlling access to said enclosed space;

a draft gear mounted to said rail car at said first end, and a releasable couplet mounted to said draft gear; and said coupler having less longitudinal free slack than an AAR Type E coupler.

11. An auto rack rail road car comprising:

a railcar body supported for rolling motion in a longitudinal direction;

said body having a first end and a second end;

said body having a housing structure including a pair of sidewalls, a roof and at least one deck;

said deck being mounted to said sidewalls;

said housing structure defining an enclosed lading space;

a draft gear mounted to said rail car at said first end, and a releasable coupler mounted to said draft gear; and a pair of left and right hand radial arm doors mounted to said first end of said rail car body, said doors being operable to control access to said deck of said auto rack roil road car.

12. A combination comprising:

a first rail road car for carrying low density, fragile lading;

a second rail road car for carrying low density, fragile lading;

said first and second rail road cars each having a body supported for rolling in a longitudinal direction;

said first and second railroad cars each having respective first and second ends;

said body of said first rail road car having a housing structure including a pair of sidewalls, a roof and at least one deck;

said deck being mounted to said sidewalls;

said housing structure defining an enclosed lading space;

said first rail road car having at least one door for controlling access to said enclosed space;

said first rail road car having first draft gear mounted to said first end of said rail road car;

said second rail road car having second draft gear mounted to said second end of said second rail road car;

said first rail road car having a first releasable coupler mounted to said first draft gear;

said second rail road car having a second releasable coupler mounted to said second draft gear;

said first and second releasable couplers being muted to form a coupling; and said first and second draft gears each having less than 2½ inches of travel at 500,000 Lbs., buff load.

13. The combination of claim 12 wherein said first and second couplers are chosen from the set of couplers consisting of: (a) AAR Type F couplers; (b) AAR Type H couplers; and (c) AAR Type CS couplers.

14. The combination of claim 12 wherein said coupling has between 0 and ⅜ inches of slack.

15. The combination of claim 12 wherein said coupling is slackless.

16. The combination of claim 12 wherein said first draft gear and said second draft gear each have a travel in buff less than 1 inch under 700,000 Lbs. load.

17. The combination of claim 12 wherein said first draft gear and said second draft gear each have a travel in buff between ⅝ and ¾ inches under 700,000 Lbs. load.

18. The combination of claim 12 wherein said first draft gear and said second draft are each Mini-Buff Gear.

19. The combination of claim 12 wherein said body of said second rail road car has a housing structure including a pair of sidewalls, a roof and at least one deck; said second rail car deck is mounted to said sidewalls; said housing structure defines an enclosed lading space; and said second rail road car has at least one door for controlling access to said second rail car enclosed space.

* * * * *

UNITED STATES PATENT AND TRADEMARK OFFICE

CERTIFICATE OF CORRECTION

PATENT NO. : 6,821,065 B2
DATED : November 23, 2004
INVENTOR(S) : James W. Forbes It is certified that error appears in the above-identified patent and that said Letters Patent is hereby corrected as shown below:

Column 17,
Line 27, replace “roil road car” with -- rail road car --.

Column 18,
Line 14, replace “being muted to” with -- being mated to --.

Signed and Sealed this

Twenty-sixth Day of April, 2005

JON W. DUDAS
*Director of the United States Patent and Trademark Office*